US006404454B1

(12) United States Patent
Nakahara et al.

(10) Patent No.: US 6,404,454 B1
(45) Date of Patent: Jun. 11, 2002

(54) OPTICAL PRINTER AND PRINT HEAD THEREOF

(75) Inventors: Toshiaki Nakahara; Yukihiko Shimizu, both of Mobara (JP)

(73) Assignee: Futaba Denshi Kogyo Kabushiki Kaisha, Chiba (JP)

( * ) Notice: Subject to any disclaimer, the term of this patent is extended or adjusted under 35 U.S.C. 154(b) by 0 days.

(21) Appl. No.: 09/498,041

(22) Filed: Feb. 4, 2000

(30) Foreign Application Priority Data

Feb. 5, 1999 (JP) ..... 11-028507

(51) Int. Cl.[7] ..... B41J 2/435
(52) U.S. Cl. ..... 347/232; 347/241; 347/256
(58) Field of Search ..... 347/232, 241, 347/242, 257, 256, 134; 430/245

(56) References Cited

U.S. PATENT DOCUMENTS

| | | | | |
|---|---|---|---|---|
| 5,051,772 A | | 9/1991 | Hattori | 355/403 |
| 5,434,600 A | | 7/1995 | Schoon | 347/243 |
| 5,760,810 A | | 6/1998 | Onodaka | 347/123 |
| 5,870,131 A | * | 2/1999 | Yuge et al. | 347/232 |

FOREIGN PATENT DOCUMENTS

| | | |
|---|---|---|
| EP | 0512924 | 11/1992 |
| JP | 3142413 | 6/1991 |

* cited by examiner

*Primary Examiner*—Hai C. Pham
(74) *Attorney, Agent, or Firm*—Rosenman & Colin LLP

(57) ABSTRACT

An optical printer performs optical writing on a film and includes a print head with a luminous source and a plurality of filters selectively set to the luminous source by moving toward a predetermined direction with respect to the luminous source, and a moving unit for allowing the print head to be reciprocated in the predetermined direction. A transfer unit is disposed the print head to allow the filters to be moved by a regular amount, i.e., a predetermined pitch("c" to "e"), thereby setting a desired filter to the luminous source. The transfer unit is operated to by the regular amount from one end side of the moving region of the print head. Further, a reset unit is disposed to the print head and is operated when the print head is moved more than the moving region from one end side ad of the moving region of the print head, forcing the moved filter to return to the original position. Furthermore, one end side of the moving region of the print head is provided with an accelerating region for accelerating the print head at a regular speed.

8 Claims, 17 Drawing Sheets

A ← → B
SUB-SCANNING DIRECTION

OPTICAL PRINTER AND PRINT HEAD THEREOF

FIELDS OF THE INVENTION

The present invention generally relates to an optical printer for example, a fixed, a portable printer and the like, for optical writing on a recording medium; and more particularly to an optical printer and a print head therefor, wherein a plurality of filters are selectively alternated or changed with respect to a common luminous source.

BACKGROUND OF THE INVENTION

As is well known, a print head in a typical optical printer includes a luminous source in which a plurality of fine luminous dots are juxtaposed along a line, the luminous source moving from a main scanning direction juxtaposing to the luminous dots to a sub-scanning direction perpendicular to the main scanning direction so as to irradiate dot-type lights on a recording medium, forming a desired image thereon. A variety of luminous elements such as a fluorescent luminous tube or LED and the like are utilized as the luminous source.

There is schematically shown in FIG. 14 a structure of a print head incorporated in a conventional optical printer, for example, a portable color printer and the like and there is shown in FIG. 15 a partial structure of the print head, with some parts omitted therefrom.

As shown in FIG. 14, a print head 100 is made to reciprocate in a sub-scanning direction, e.g., with respect to a film 102 acting as a recording medium placed at a predetermined position. That is, as shown in FIG. 15, the print head 100 is guided by a pair of guide shafts 104 which are positioned parallel to the sub-scanning direction and is connected to a pulse motor 106 through a wire 108 to be driven, thereby allowing the print head 100 to reciprocate in the sub-scanning direction. Further, the print head 100 includes a luminous element 110 acting as a luminous source, the luminous element 110 having a plurality of luminous dots that are positioned parallel to the main scanning direction. Light emitted from the luminous element 110 passes through three filters R,G,B as described hereinafter and is imaged through a reflective optical element (mirror) 112, a single optical system(lens) 114, and a reflective optical element (mirror) 116 to the film 102.

As shown in FIG. 14, each of the red filter R, the green filter G and the blue filter B is disposed on an irradiating side of the luminous element 110 to be alternated or changed as desired. As shown in FIG. 15, the three filters R,G,B are mounted on a common filter holder 118 in such a way that longer sides thereof are parallel to the main scanning direction and shorter sides are parallel to the sub-scanning direction. The filter holder 118 is provided with a projection 120 for manipulating the filter holder 118, the projection 120 projecting in the sub-scanning direction. Also, the projection 120 is maintained between a guide bearing 122 and a position determining bearing 124. The position determining bearing 124 is biased by a spring 126 and engaged with any one of three cut-off portions 128 formed on the projection 120. The filter holder 118 is compressed by a spring 130 toward a predetermined direction in the sub-scanning direction. An abutment 132 is disposed at a predetermined distance from the projection 120 and a reset plate 134 is disposed at an opposite side therefrom in such a manner that the print head 100 is sandwiched therebetween. That is, when the projection 120 of the filter holder 118 comes in contact with the abutment 132 as a result of the print head 100 moving, the filter holder 118 also moves, allowing the filters R,G,B to be alternated or changed as desired. Further, when the print head 100 is moved in an opposite direction as described above, resulting in the reset plate 134 shifting a shaft 136 of the position determining bearing 124, the engagement of the filter holder 118 is released by the position determining bearing 124 and the spring 130 allows the filter holder 118 to move toward a direction of the abutment 132.

A writing operation on the film 102 using the above-described structure will be described using FIG. 16. There is shown in FIG. 16 a moving chart of the print head 100. As shown, reference numeral "a" indicates a filter reset position, a region between reference numerals "b" and "c" is referred to as an accelerating region, a region between reference numerals "c" and "d" is an exposure region, and a region between reference numerals "d" and "f" is a change-over region of the filters R,G,B. Further, Δ marks in the drawing is referred to as a position of the luminous source 110, i.e., a luminous dot row. In the above-described print head 100, a full-color image is formed on the film 102 by color-separating an image into three images of primary colors of R,G,B and superposing the three images.

As shown in FIG. 16, the reset plate 134 moves the shaft 136 of the position determining bearing 124 when the print head 100 is moved to the "a" position, which, in turn, results in the filter holder 118 moving to right by the elastic force of the spring to be reset at an initial position. At this position, the filter R is set at a light irradiating position (referred to as Δ mark) of the luminous element 110.

The printer head 100, as shown in FIG. 16, accelerates at a regular speed through the accelerating region, i.e., between "b" and "c" along the sub-scanning direction and moves to the exposure region, i.e., between "c" and "d". In synch with this operation, the luminous element 110 is driven with an image signal of red R, forming the image in red R on the film.

Furthermore, at the completion of the forming of the image in red R on the film, the projection 120 of the filter holder 118 comes in contact with the abutment 132 at the changing-over region, allowing the filter holder 118 to move and the filter to change-over from red R to green G.

Next, the print head 100 moves to the "b" position. At this position, since the reset plate 134 and the shaft 136 of the position determining bearing 124 are not in contact with each other, the filters are not reset. The print head, as shown in FIG. 16, is accelerated at the regular speed through the accelerating region along the subscanning direction and moves to the exposure region. In synch with this operation, the luminous element 110 is driven with an image signal of green G, forming an image in green G on the film. At the completion of the forming of the image in green on the film, the projection 120 of the filter holder 118 comes in contact with the abutment 132 at the change-over region, i.e., between "e" and "f", allowing the filter holder 118 to move and causing the filter to change-over from green G to blue B.

Again, the print head 100 moves to "b" position. At this position, since the reset plate 134 and the shaft 136 of the position determining bearing 124 are not in contact with each other, the filters are not reset. Further, the print head 100, as shown in FIG. 16, is accelerated at the regular speed through the accelerating region and moves to the exposure region. In synch with this operation, the eluminous element 110 is driven with an image signal of blue B, forming an image in blue B on the film.

Next, the print head 100 moves to the "a" position as shown in FIG. 16, the reset plate 134 and the shaft 136 of the filter holder 124 come in contact with each other and the filter is reset as red R.

As described above, in the conventional optical printer, the print head 100 is movable in the sub-scanning direction with respect to the film 102 placed at a desired position. Further, the print head 100 is constructed in such a way that the change-overs among the filters R,G,B being movable in the sub-scanning direction, are accomplished only by the movement thereof.

However, in the conventional optical printer as described, the change-over from green G to blue B takes place when the print head 100 moves and comes in contact with the abutment 132 shown at the right side in FIG. 15 and the resetting to red R takes place when the print head 100 moves and comes in contact with the reset plate 134 shown at the left side in FIG. 15. In other words, there are formed on, both right and left, change-over regions, the change-over resulting from the print head 100 moving. The existence of change-over regions in two opposite direction runs counter to the down-sizing of the optical printer.

In addition, during the change-over from green G to blue B, since an independent change-over region, i.e., between "d" and "e" and "e" and "f" in FIG. 16 exists at each of the pitches of the filters of green G and blue B, the print head must move accordingly. Further, the description above is referred to a situation where only three filters of R,G,B are used. However, if three or more filters are required to change-over, the print head 100 must move accordingly, except for one pitch of one filter.

Further, even though the amount of movement of the print head 100 is controlled by recognizing a pulse number of the pulse motor 106, the amount of movement thereof required is different, as shown in FIG. 16, when it moves from right to left and vice versa, thereby making the control thereof difficult and complicated.

SUMMARY OF THE INVENTION

It is, therefore, an object of the present invention to provide an optical printer and a print head therefor capable of small-sizing of an apparatus by reducing a moving amount of the print head and simplifying a control according to the movement of the print head.

In accordance with one aspect of the present invention, there is provided an optical printer for optical writing on a recording medium and having a print head with a luminous source and a plurality of filters selectively set to a luminous section of the luminous source by moving toward a predetermined direction with respect to the luminous source, and a moving means for allowing the print head to be reciprocated in the predetermined direction, the optical printer comprising: a transfer means disposed the print head and for allowing the filters to be moved to the predetermined direction by a regular amount, thereby setting a desired filter to the luminous source; an abutting means disposed to one end side of the moving region of the print head and is abutted to the transfer means when the print head is moved to one end side of the moving region, thereby allowing the transfer means to operate in the regular amount; and a reset means disposed to the print head and operated at the same side as the abutting means for resetting the filter to its initial position when the print head is moved more than the moving region.

In a preferred embodiment of the present invention, the optical printer further may include an accelerating region for accelerating the print head at a regular speed to the other end side of the moving region by being disposed to the same side as the abutting portion.

In a preferred embodiment of the present invention, each of the filters may have a predetermined pitch in the predetermined direction and is maintained in a filter holder resiliently supported to be moved toward the predetermined direction with respect to the luminous source, the transfer means may include a transferring portion detachably engaged to the filter holder and for moving the filter holder by the predetermined pitch of the filters against the elastic force by the regular amount to be abutted to the abutment, and an engagement engaged with the filter holder moved by the transferring portion against the elastic force, thereby positioning a desired filter to correspond to a position set to the luminous source, and the reset means may be positioned at the same side as the abutting portion and may release simultaneously the filter holder from the engagement and the engagement of the transferring portion with the filter holder when the print head is moved more than the moving region.

In accordance with the other aspect of the present invention, there is provided a print head of an optical printer for optical writing on a recording medium during moving toward a predetermined direction by a moving means, the print head comprising: a base having a luminous source and movably disposed in the predetermined direction by the moving means; a filter holder having a predetermined pitch toward the predetermined direction to thereby maintain a plurality of filters therein and resiliently supported to the base to allow the filters to be moved toward the predetermined direction on the luminous source; a transfer means abutted to one portion of the optical printer when the base is moved to one end side of the moving region by the moving means and engaged to allow the filter to be moved by the predetermined pitch toward the predetermined direction by the regular amount against the elastic force so that a desired filter is set to the luminous source; and a reset means for releasing the engagement with the filter holder in the transfer means when the base is moved more than the moving region from one end side of the moving region.

In a preferred embodiment of the present invention, the transfer means may include a transferring portion detachably engaged to the filter holder and for moving the filter holder to be moved by the predetermined pitch of the filters against the elastic force of the filter by the regular amount to be abutted to a portion of the optical printer, and an engagement engaged with the filter holder moved by the transferring portion against the elastic force, thereby positioning the desired filter to correspond to a position set to the luminous source, and the reset means may simultaneously release the filter holder from the engagement and the engagement of the transferring portion with the filter holder when the base is moved more than the moving region from one end side of the moving region.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

A first preferred embodiment of the present invention will now be described hereinafter with reference to the drawings.

Figure 1B:
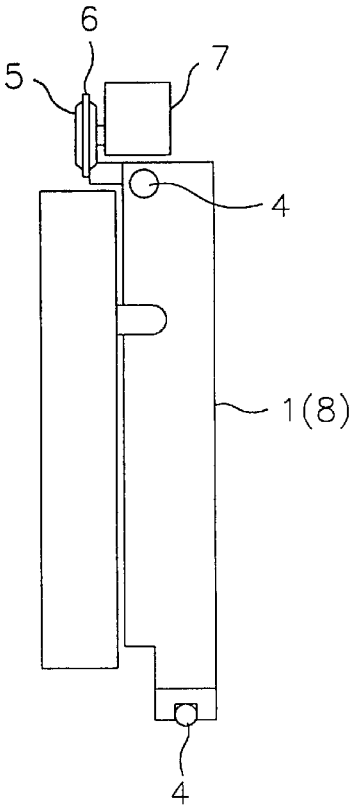
FIGS. 1A and 1B illustrate a plan view and a cross sectional view showing an optical printer in accordance with a first preferred embodiment of the present invention, respectively.
Figure 1A:
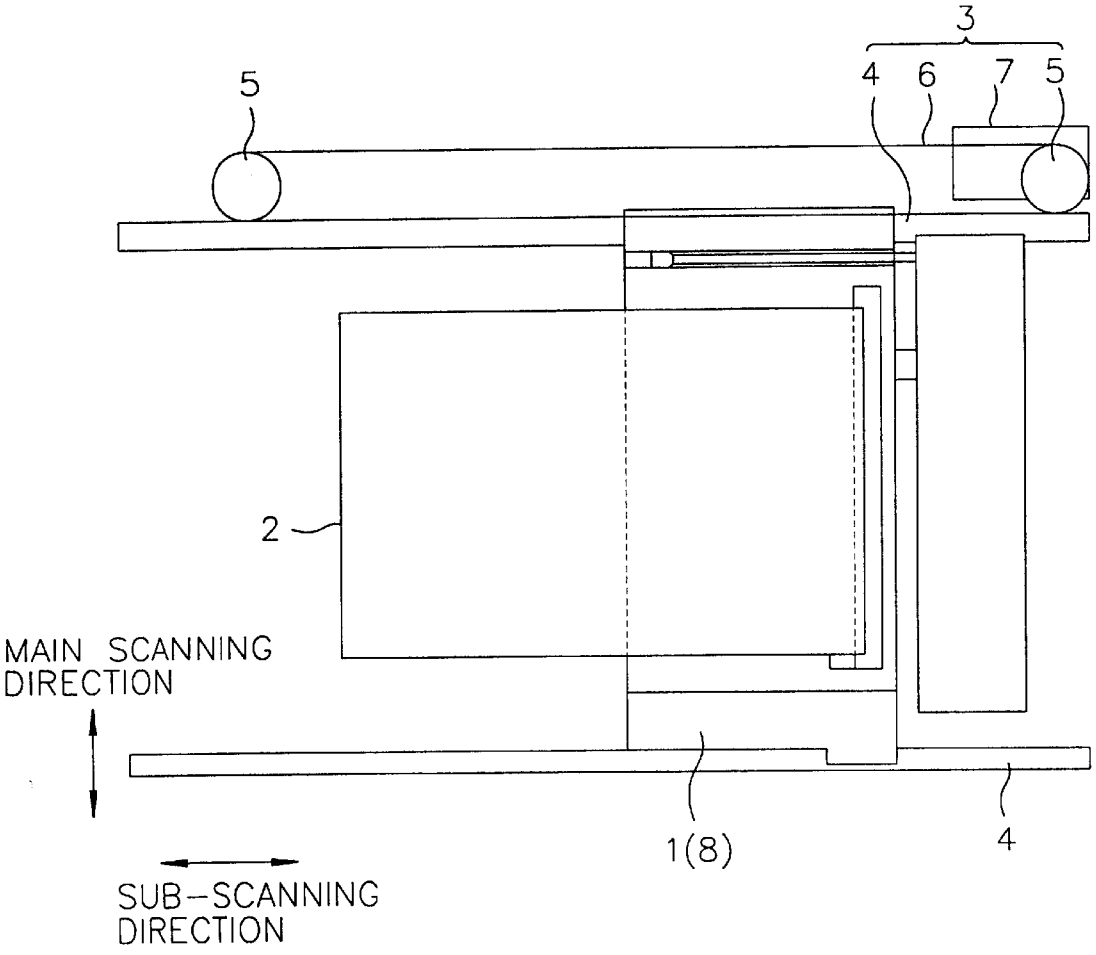
Figure 2:
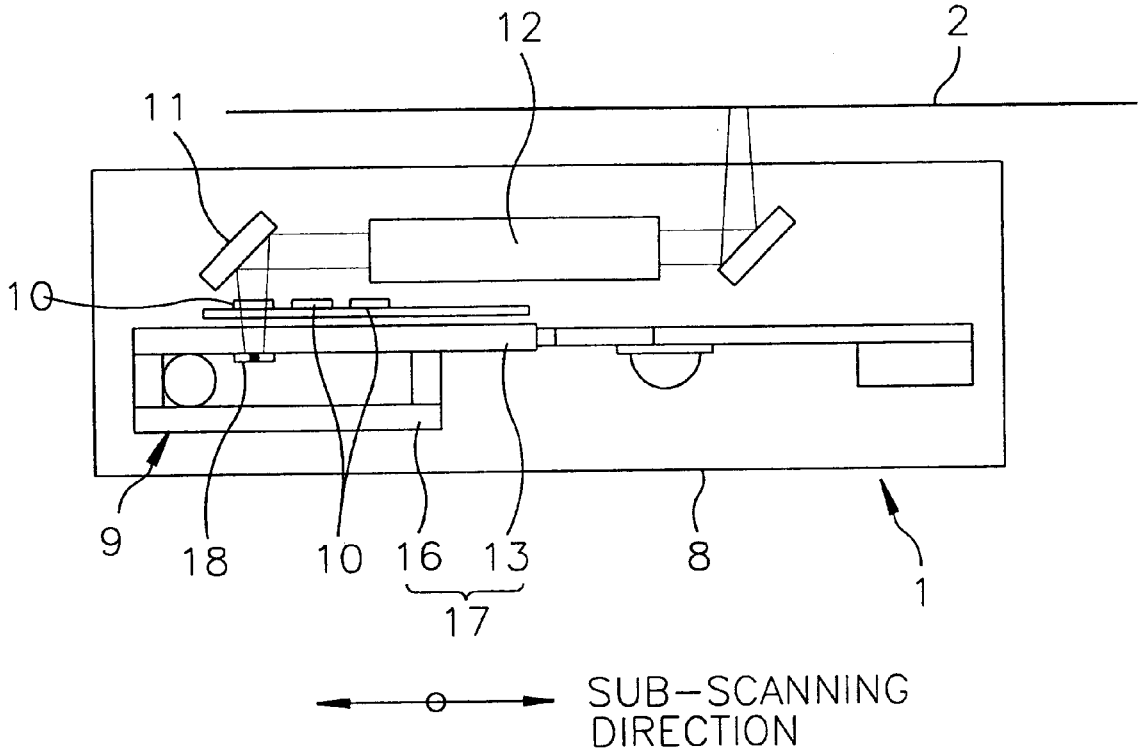
FIG. 2 shows a sectional view schematically showing a print head incorporated in the optical printer of FIG. 1.

FIGS. 1A and 1B are a plan view and a cross-sectional view of an optical printer in accordance with a first embodiment of the present invention, respectively, and FIG. 2 is a schematic view showing an optical system of a print head of the optical printer in FIG. 1.

The optical printer, as shown in FIGS. 1A and 1B, allows the print head 1 to be reciprocated in a predetermined direction by a moving means 3 on a film 2 acting as a recording medium placed at a desired position therefrom. The moving means 3 is provided with a pair of guide shafts 4 which are positioned parallel to a sub-scanning direction. Further, the moving means 3 has a pair of pulleys 5, the pulleys being placed at two opposite end sides of one of the guide shafts, respectively, and being connected to each other through a wire 6 wound therearound. One of the pulleys 5 is rotated by a pulse motor 7, the rotation of the pulley 5 being transferred to the other pulley 5 through the wire 6. The print head 1 is guided by the guide shafts 4 and a portion thereof is fixed to the wire 6. That is, when the pulse motor 7 is driven to circulate the wire 6 between the pulleys 5, the print head 1 moves along the sub-scanning direction by being guided by the guide shafts.

The print head 1 capable of being moved along the sub-scanning direction by the moving means 3 is guided by the guide shafts 4 and has a base 8 fixed to the wire 6, the base being provided with each of the optical elements. The optical elements, as shown in FIG. 2, includes a luminous source 9, filters 10, a reflective optical element 11, and an equal magnification lens 12.

In this embodiment, it is preferred that the luminous source 9 may employ a fluorescent luminous tube. The tube has a substrate 15 constructed of a glass material having a light-permeability and an insulating property and a substantial rectangular envelope 17 formed by attaching a box-like container 16 on the substrate 15, an inside of the envelope 17 being evacuated to a high vacuum. A plurality of luminous dots 18 acting as a luminous portion which are arranged at regular intervals in two lines along a main scanning direction are formed on the substrate 15 inside the envelope 17. The luminous dots 18 include anode conductors formed at the substrate 15 and a phosphor layer deposited on each of the anode conductors, the phosphor layer being formed of ZnO:Zn phosphor material. Further, not shown, a line-shaped cathode acting as an electron source along the main scanning direction is disposed below the luminous dots 18. The anode conductors of each of the luminous dots 18 are independently taken out of the envelope 17 and is independently driven by a driving signal applied thereto.

The filters 10 in three primary luminous colors of red R, green G, and blue B, each being arranged lengthwise along the luminous dots 18 on the substrate 15 in the main scanning direction and maintained at the same pitch in a sub-scanning direction with respect to a filter holder 20.

Further, the filter holder 20 for holding the respective filters is slidably mounted in the sub-scanning direction with respect to the base 8.

The reflective optical elements 11, in this case, mirrors, are disposed at the base 8 to thereby allow light from the luminous dots 18 of the luminous source 9 to be focused only on the film 2, not on the base 8. The reflective optical elements 11 are disposed at two positions in such a manner that the light from the luminous dots 18 is introduced into the sub-scanning direction and then introduced only onto the film 2, not on the base 8, i.e., toward an upper portion in FIG. 2.

The equal magnification optical system 12, also known as a lens, is disposed at the base 8 so as to be placed between the reflective optical elements 11. The optical system 12 comprises a plurality of substantially cylindrical lenses, i.e., SELFOC lenses(Registered trademark) corresponding to each of the luminous dots 18 in the embodiment, the lenses being formed into a module.

The light emitted from the luminous dots 18 of the luminous source 9 permeates any one of the R, G, and B filters 10 by the respective optical elements as described above and is irradiated only onto the film 2, not on the base 8, i.e., excluding the print head 1, through one portion of the reflective optical element 11, the equal magnification optical system 12, and the other reflective optical element 11. This results in a line-shaped image being written on the film 2 in the main scanning direction. Further, the print head 1 is moved by the moving means 3 in the sub-scanning direction to thereby permit a planer image to be formed on the film 2.

The filter holder 20 is moved in the sub-scanning direction to selectively change-over the filters R,G,B to thereby expose the respective colors. The fluorescent luminous tube is driven by a corresponding signal produced by the changing-over of the filters 10, permitting color images to be formed on the film 2.

Hereinafter, a change-over mechanism for changing-over the filters 10 will be described.

Figure 3:
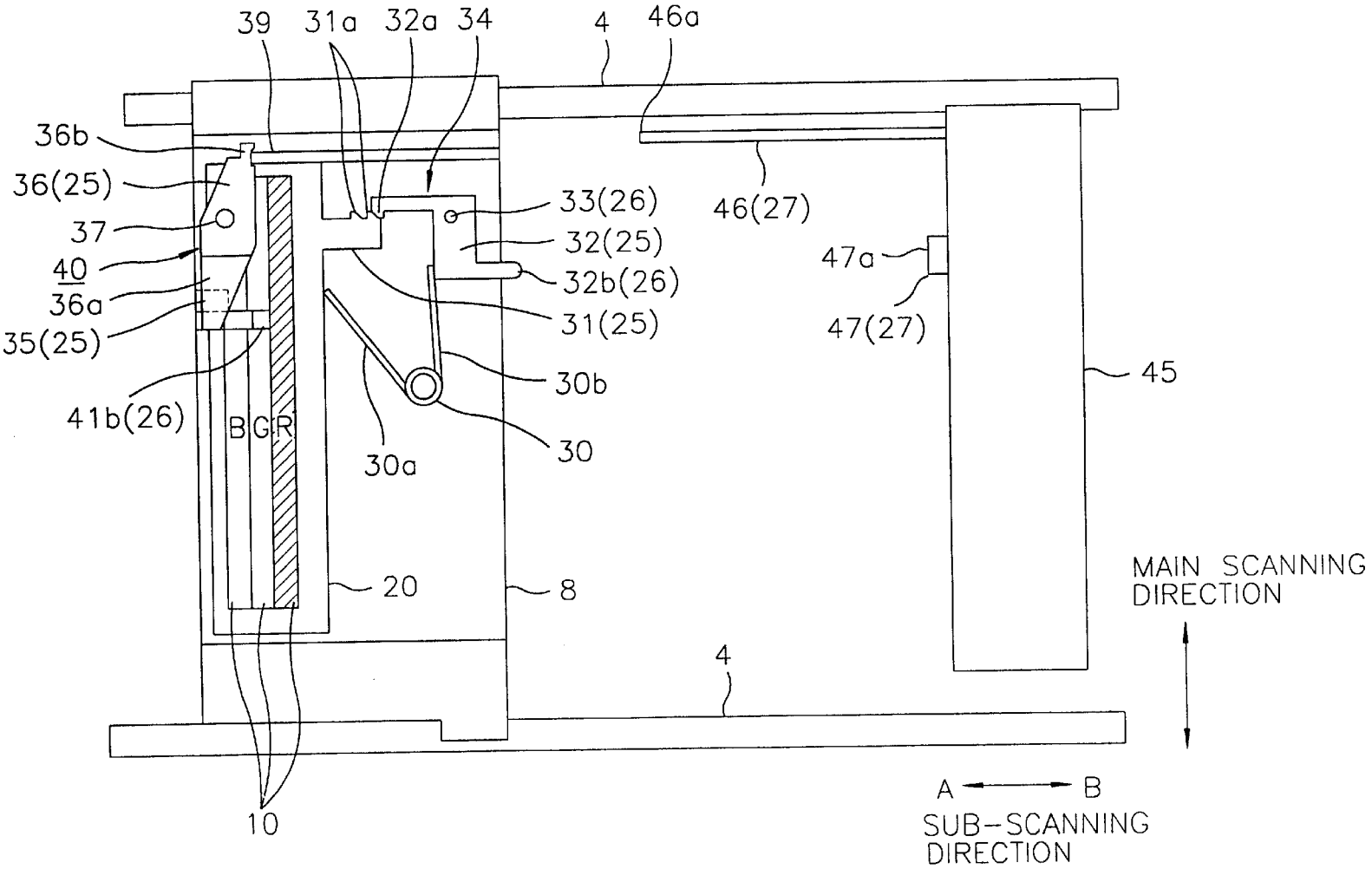
FIG. 3 is a plan view schematically showing a change-over mechanism in the first embodiment of the present invention.
Figure 4:
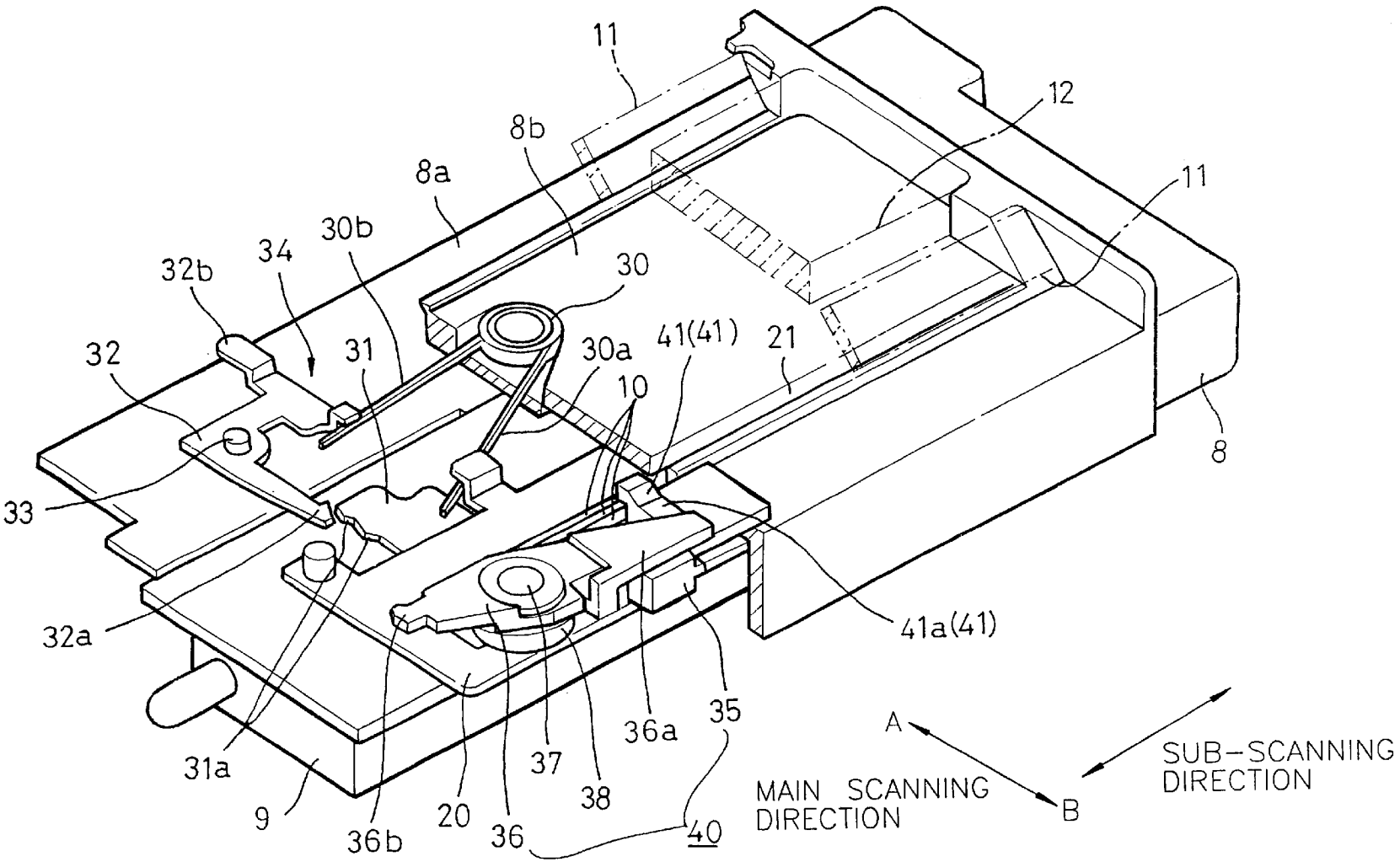
FIG. 4 is a perspective view of the change-over mechanism of FIG. 3.
Figure 5:
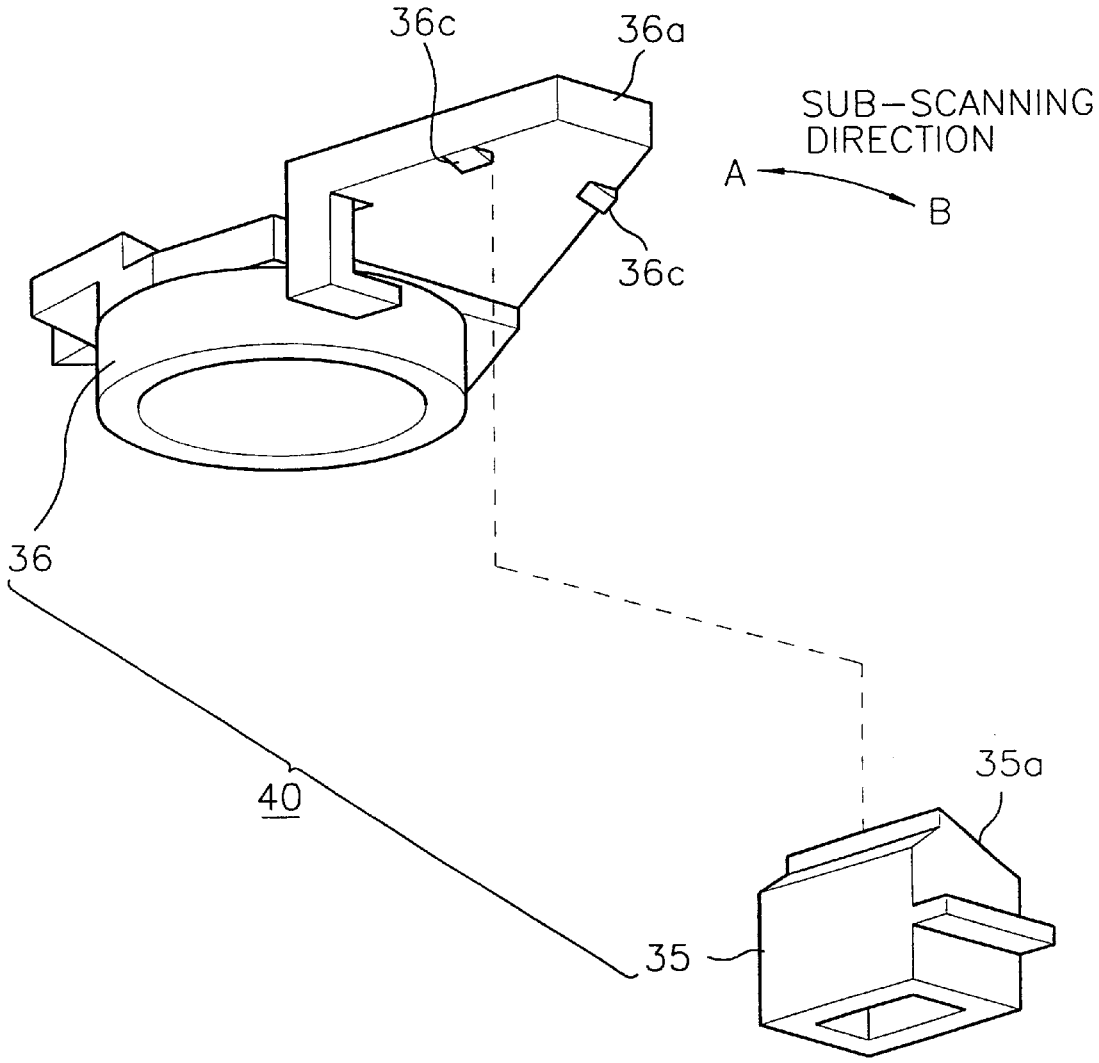
FIG. 5 is a perspective view partially showing the change-over mechanism of FIG. 3.

FIG. 3 is a schematic plan view showing the change-over mechanism in accordance with the first embodiment of the present invention, FIG. 4 is a perspective view of the change-over mechanism, and FIG. 5 is a perspective view partially showing the change-over mechanism.

The change-over mechanism of the filters 10 capable of moving the filter holder 20 in the sub-scanning direction as described above includes a transfer means 25 and a reset means 26 located at a side of the print head 1 as shown in FIG. 3. Further, since the change-over mechanism in the first embodiment operates only when the print head 1 is moved by the moving means 3 as described above, it further includes an abutment 27 related to the transfer means 25 and the reset means 26 with respect to a chassis(not shown) side of the optical printer having the moving means 3.

First, the transfer means 25 and the reset means 26 will be described.

As shown in FIG. 4, the base 8 of the print head 1 is a two-layered structure including an upper layer 8*b* and a lower layer 8*a*, the lower layer being provided with the luminous source 9 and the filter holder 20 as described above and the upper layer being provided with the reflective optical elements(mirror) 11 and the equal magnification optical system(lens) 12 as described above. Further, the lower layer 8*a* is provided with the filter holder 20 slidably disposed in the sub-scanning direction between the upper and the lower layers. The filter holder 20 is always resiliently supported in one direction(A direction in FIGS. 3 and 4) of the sub-scanning direction by one end 30*a* of a twist coil spring 30. Further, the upper layer 8*b* is provided with a through-hole 21 of a lengthwise slit shape in the main scanning direction for passing through the light emitted from the luminous source 9(the luminous dots 18) for permeating the filters 10 toward the reflective optical elements 11.

The transfer means 25 is disposed to be related to the filter holder 20 and the upper layer 8*b*.

The filter holder 20 resiliently supported by the twist coil spring 30 in one direction(A direction in FIGS. 3 and 4) side of the sub-scanning direction is provided with a ratchet 31 extended into the other direction(B direction in FIGS. 3 and 4) side of the sub-scanning direction opposite to the resiliently supported direction. The ratchet 31 is provided with two pawls 31*a* formed at the same pitch and direction as the respective filters 10.

The lower layer 8*a* is provided with an engagement 32. The engagement 32 has an engaging pawl 32*a* for engaging with each of the pawls 31*a* of the ratchet 31. The engagement 32 is swingably disposed through a shaft 33 against the lower layer 8*a*. The swing of the engagement 32 is elastically supported by the other end 30*b* of the twist coil spring 30, allowing the engaging pawl 32*a* to be engaged with each of the pawls 31*a* of the ratchet 3l.

The engaging pawl 32*a* of the engagement 32 becomes engaged with each of the pawls 31*a* as the filter holder 20 slides against the elastic force of the twist coil spring 30 and moves near to the engagement 32. At this time, the engagement 32 climbs over the pawl 31*a* engaged therewith to thereby swing against the elastic force of the twist coil spring 30 (see FIG. 6). Likewise, when the filter holder 20 is slid to thereby permit the ratchet 31 to be further adjacent thereto, the engagement 32 climbs over the next pawl 31*a* to thereby be engaged therewith (see FIG. 7).

Further, when the engagement 32 is not engaged with each of the pawls 31*a*, as shown in FIGS. 3 and 4, the engagement 32 and the ratchet 31 are separated farthest from each other (an initial position). In other words, there exists a total of three conditions of engagements including, i.e., the initial position and the above-described two conditions where the engaging pawl 32*a* is engaged with the two pawls 31*a*, respectively, (see FIGS. 6 and 7) as the ratchet 31 (the filter holder 20) moves closer to the engaging pawl 32*a*. The three conditions corresponds to the positions at which the three filters 10 of R,G,B are aligned to the through-holes 21, respectively. In this embodiment, the filter 10 corresponding to the through-hole 21 at the initial position is a red filter, and the filters 10 of green G and blue B correspond to the through-holes 21 according to the order of the engagement.

As described above, an engaging portion 34 of the transfer means 25 includes the ratchet 31 and the engagement 32, the ratchet 31 being slidably positioned to the filter holder 20 which is resiliently supported and the engagement 32 forcing each of the R,G,B of the filters 10 of filter holder 20 which is slid in relation to the ratchet 31 to correspond to the respective through-holes 21.

On the other hand, an engaging pin 35 fixed in the same direction(A direction in FIGS. 3 and 4) as the filter holder 20 is resiliently supported, i.e., in the sub-scanning direction. A pawl 35*a*, as shown in FIG. 5, is disposed to an upper surface of the engaging pin 35. The upper surface of the engaging pin 35 having the pawl 35*a* is projected upward from the upper layer 8*b*. Further, the upper layer 8*b* moves with the engaging pin 35 projected upward from the upper layer 8*b* by the sliding of the filter holder 20.

Further, the upper layer 8*b* is disposed to a longitudinal transfer arm 36. The transfer arm 36 is pivoted to about lengthwise center portion thereof through a shaft 37 to thereby be swung in the sub-scanning direction. The swing of the transfer arm 36 is resiliently supported by a twist coil spring 38 wound around the shaft 37, one end 36*a* thereof being swung toward one direction(A direction in FIGS. 3 and 4) of the sub-scanning direction, while the other end 36*b* thereof being swung toward the other direction (B direction in FIGS. 3 and 4) thereof. However, the other end 36*b* is in contact with a projection 39 placed to the base 8 as shown in FIG. 3 so that the swing of the transfer arm 36 by the elastic force of the twist coil spring 38 is restricted to a predetermined range.

One end 36*a* of the transfer arm 36 is placed on the pawl 35*a* of the engaging pin 35. A couple of transferring pawls 36*c* engaged with the pawl 35*a*, as shown in FIG. 5, are disposed to a bottom surface of one end 36*a* of the transfer arm 36, allowing them to have the same direction and pitch as the respective filters 10.

Further, each of the transferring pawls 36*c* of the transfer arm 36 and the pawl 35*a* of the engaging pin 35 are engaged with each other when one end 36*a* of the transfer arm 36 is swung toward the other direction(B direction in FIG. 5) of the sub-scanning direction against the elastic force of the twist coil spring 38. That is, when the transferring pawls 36*c* are engaged with the pawls 35*a* by the swing toward the other direction of the sub-scanning direction in one end 36*a* of the transfer arm 36, the engaging pin 35 is pushed to the other direction of the sub-scanning direction to thereby allow the filter holder 20 to move in the same direction. The moved filter holder 20 is engaged at a position corresponding to moving at one pitch of the filter 10 by the operation of the above-described engaging portion 34(see FIG. 6).

Further, when each of the transferring pawls 36*c* and the pawls 35 are swung to be returned toward one direction(A direction in FIG. 5) of the sub-scanning direction by the elastic force of the twist coil spring 38, it does not become engaged at a common slant portion of each other. In this case, since one end 36*a* of the transfer arm 36 is formed to be twisted upward, the transferring pawls 36c climb over the pawls 35*a*. That is, the transfer arm 36 returns to a predetermined position where the other end 36*b* comes in contact with the projection 39 as shown in FIG. 3 after the filter holder 20 is moved corresponding to one pitch of the filter 10.

In the engagement of the respective transferring pawls 36*c* with the pawls 35*a*, as indicated with two dotted lines in FIG. 5, the condition in which the transferring pawls 36*c* partially placed in one direction(A direction in FIG. 5) of the sub-scanning direction are engaged with the pawls 35*a* is the initial position as shown in FIGS. 3 and 4 at which the engaging pawls 32*a* of the engagement 32 are not engaged with each of the pawls 31*a* of the ratchet 31 and the filter 10 of red R corresponds to the through-hole 21 in this embodiment.

Further, when the transfer arm 36 returns to the predetermined position after one end 36*a* of the transfer arm is swung toward the B direction in FIG. 5 by engaging the transferring pawls 36*c* partially placed toward one direction(A direction in FIG. 5) of the sub-scanning direction with the pawls 35*a*, the filter holder 20 is moved corresponding to one pitch of the filter 10 by the operation of the engaging portion 34 as described above(see FIG. 6), thereby allowing the filter 10 of green G to correspond to the through-hole 21. Further, under this condition, since the engaging pin 35 is moved by one pitch of the filter 10 by the movement of the filter holder 20, the transferring pawls 36*c* partially placed to the other direction(B direction in FIG. 5) of the sub-scanning direction are engaged with the pawls 35*a*.

Next, the transferring pawls 36*c* partially placed on the other direction(B direction in FIG. 5) of the sub-scanning direction become engaged with the pawls 35*a* so that when the transfer arm 36 returns to the predetermined position after one end 36*a* of the transfer arm 36 is swung toward the B direction in FIG. 5, the filter holder 20 is further moved by one pitch of the filter 10 by the operation of the engaging portion 34 (see FIG. 7), allowing the filter 10 of blue B to correspond to the through-hole 21. Further, under this condition, since the engaging pin 35 is further moved by one pitch of the filter 10 by the movement of the filter holder 20, the transferring pawls 36*c* partially placed on the other direction(B direction in FIG. 5) of the sub-scanning direction moves away by one pitch of the filter 10 from the pawls 35*a*.

As described above, the transfer arm 36 permits the filter holder 20 to move by one pitch of the filter 10 as a result of the reciprocating swing operation in a regular amount. In order to perform the operation, a transferring portion 40 in the transfer means 25 includes the engaging pin 35 and the transfer arm 36.

The reset means 26 is disposed with the above-described engagement 32 and the upper layer 8*b* connected to one end 36*a* of the transfer arm 36.

As shown in FIGS. 3 and 4, the engagement 32 is provided with an operating lever 32*b* which extends toward the other direction(B direction in FIGS. 3 and 4) of the sub-scanning direction from the base 8. When the operating lever 32*b* is pressed toward one direction(A direction in FIGS. 3 and 4) of the sub-scanning direction, the engagement 32 is swung against the elastic force of the twist coil spring 30 to thereby release the pawl 31*a* of the ratchet 31 from the engaging pawl 32*a*. The filter holder 20 then slides in the sub-scanning direction(A direction in FIGS. 3 and 4) by the elastic force of the twist coil spring 30, returning to the initial position.

The operating surface 41 coming in contact with a bottom surface of one end 36*a* of the transfer arm 36 is disposed to the upper layer 8*b* side below the bottom surface of one end 36*a* thereof. The operating surface 41 has a flat surface 41*a* at a portion where one end 36*a* of the transfer arm 36 corresponds to the regular swing region in which the filter holder 20 is moved by one pitch of the filter 10 as described above. Further, the operating surface 41 has a slant surface 41*b* inclined upward toward the other direction(B direction in FIGS. 3 and 4) of the sub-scanning direction from the flat surface 41*a* to allow one end 36*a* of the transfer arm 36 to be further swung to the other direction (B direction in FIGS. 3 and 4) of the sub-scanning direction from the regular swing region. Each of the transferring pawls 36*c* of the transfer arm 36 is not engaged with the pawls 35*a* of the engaging pin 35 placed below thereof because the pawls 36*c* and 35 are raised up together.

Since the operation of the operating lever 32*b* of the engagement 32 and the operation of the slant surface 41*b* of the operating surface 41 are generated together, the filter holder 20 is released and returns to the initial position. At the same time, the pawls 35 in the engaging pin 35 moving by this releasing operation release the engagement with the transferring pawls 36*a*, returning to the initial position without preventing the movement of the filter holder 20.

Next, the abutment 27 will be described hereinafter.

The abutment 27 is disposed to an abutting base 45 fixed to one end side of the reciprocated moving region of the print head 1 in the other direction(B direction in FIG. 3) of the sub-scanning direction as shown in FIG. 3 with respect to a chassis (not shown) of the optical printer having the above-described moving mechanism 3.

In the abutting base 45, a transferring abutment 46 is disposed toward one direction(A direction in FIG. 3) of the sub-scanning direction facing to the print head 1. The transferring abutment 46 has a bar-shaped form and is disposed to be extended into the moving region side of the print head 1. A tip 46*a* of the transferring abutment 46 is abutted to the other end 36*b* of the transfer arm 36 consisting of the transferring portion 40 of the transfer means 25. When the print head 1 moves toward the other direction (B direction in FIG. 3) of the sub-scanning direction and reaches one end side of the reciprocating region of the print head 1, the tip 46*a* of the transferring abutment 46 gets abutted to the other end 36*b* of the transfer arm 36. The transferring abutment 46 forces the transfer arm 36 to be swung by a fixed amount by moving the print head 1. In addition, the transferring abutment 46 carries out the above-described operation in which one end 36*a* of the transfer arm 36 is raised upward by the slant surface 41*b* when the print head 1 moves a larger distance than the fixed amount by which the transfer arm is swung toward the other direction(B direction in FIG. 3) of the sub-scanning direction. As a consequence, the filter holder moves by one pitch of the filter 10.

Further, a reset abutment 47 is disposed toward one direction(A direction in FIG. 3) of the sub-scanning direction in the abutting base 45 facing the print head 1. A tip 47*a* of the reset abutment 47 is abutted to the operating lever 32*b* of the engagement 32 acting as the reset means 26 when the print head 1 moves toward the other direction (B direction in FIG. 3) of the sub-scanning direction to reach one end side of the reciprocating region. To be more specific, the tip 47*a* is not abutted to the lever 32*b* when the transferring abutment 46 is swinging the transfer arm 36 by the fixed amount, while the tip 47*a* is abutted to the lever 32*b* when the print head 1 moves a larger distance than the fixed amount by which the transfer arm is swung toward the other direction(B direction in FIG. 3) of the sub-scanning direction to the above-described operation, in which one end 36*a* of the transfer arm 36 is raised upward by the slant surface 41*b*.

Figure 6:
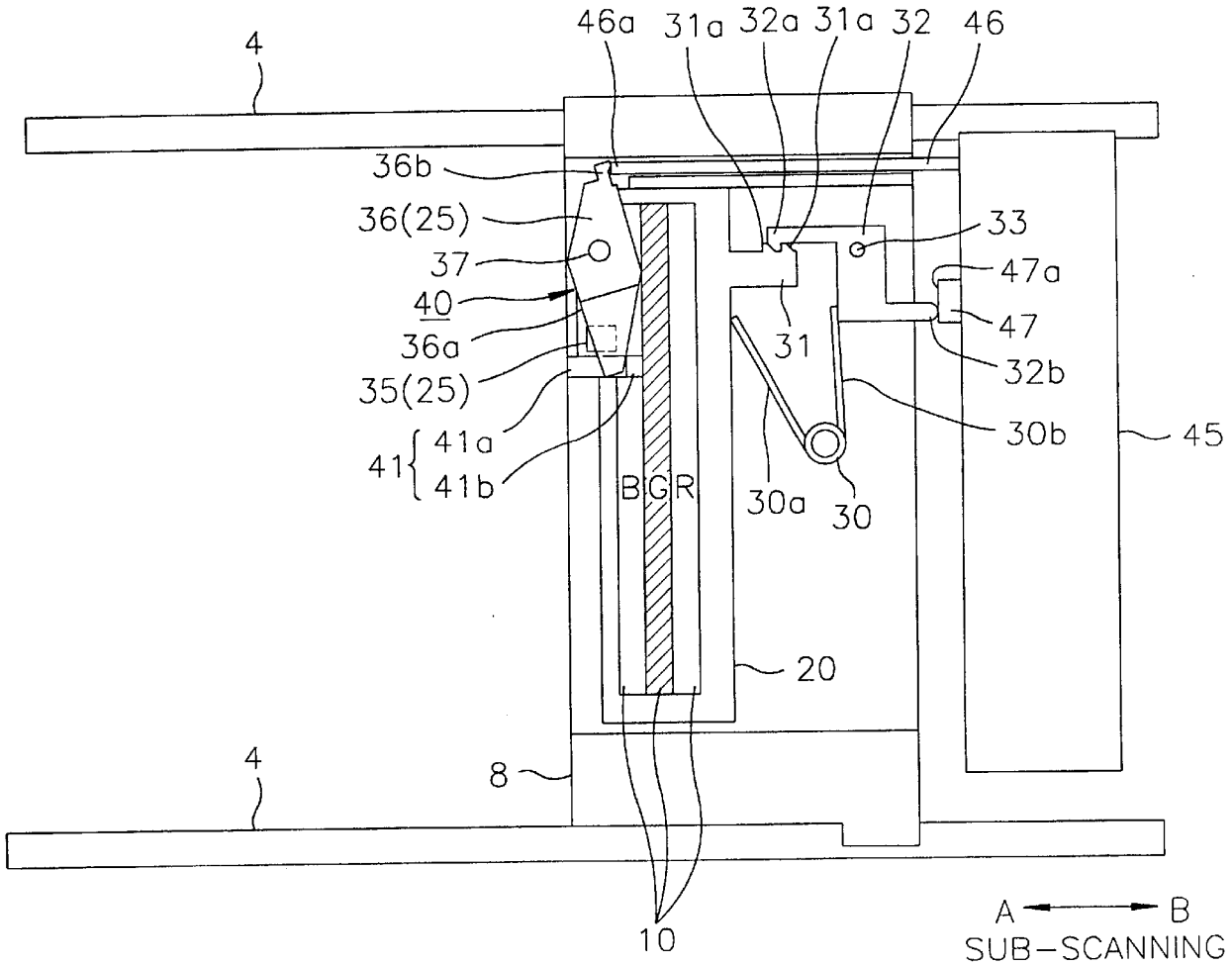
FIGS. 6 to 8 each are plan views showing operation of the change-over mechanism of FIG. 3.
Figure 7:
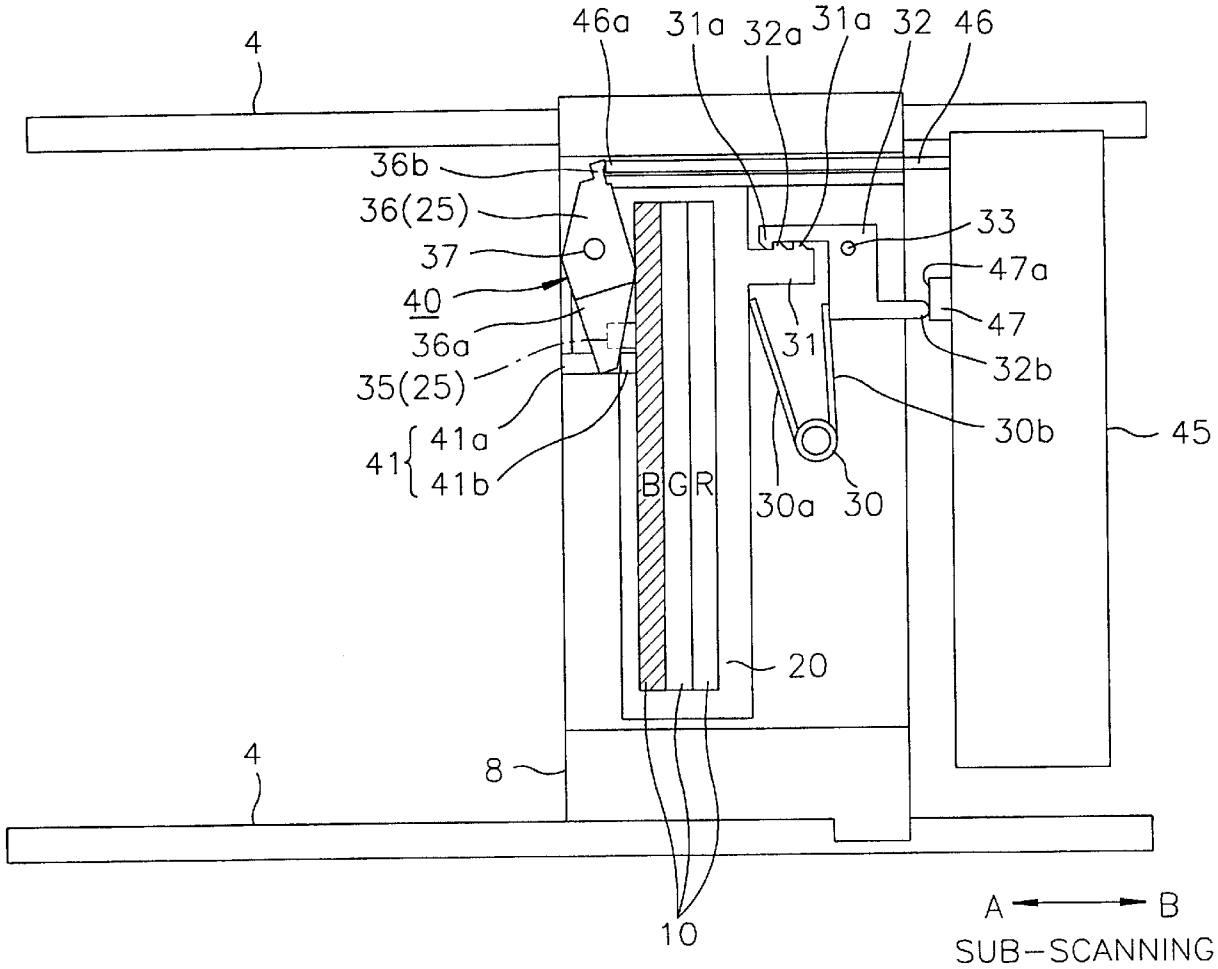

Accordingly, the transferring abutment 46 swings the transfer arm 36 by the fixed amount by moving toward one end side of the reciprocating region of the print head 1, forcing the filter holder 20 to move by one pitch of the filter 10 (see FIGS. 6 and 7). Further, when the print head 1 is moved a larger distance than the fixed amount toward one end side of the reciprocating region of the print head 1, the transferring abutment 46 and the reset abutment 47 operate the reset means 26 to allow the filter holder 20 to be placed at the initial position as shown in FIG. 3, allowing the filter 10 to be changed-over to red R (see FIG. 8).

Further, the disposal of the abutting means 27 should not be restricted to situation where it is disposed to the abutting base 45. It is preferred that as a part of the optical printer, the abutting means may be disposed with the transferring abutment 46 and the reset abutment 47.

The exposure operation of the optical printer and the change-over operation of the filter in accordance with the first embodiment of the present invention will be described hereinafter with reference to a moving chart of the print head of FIG. 9.

Figure 9:
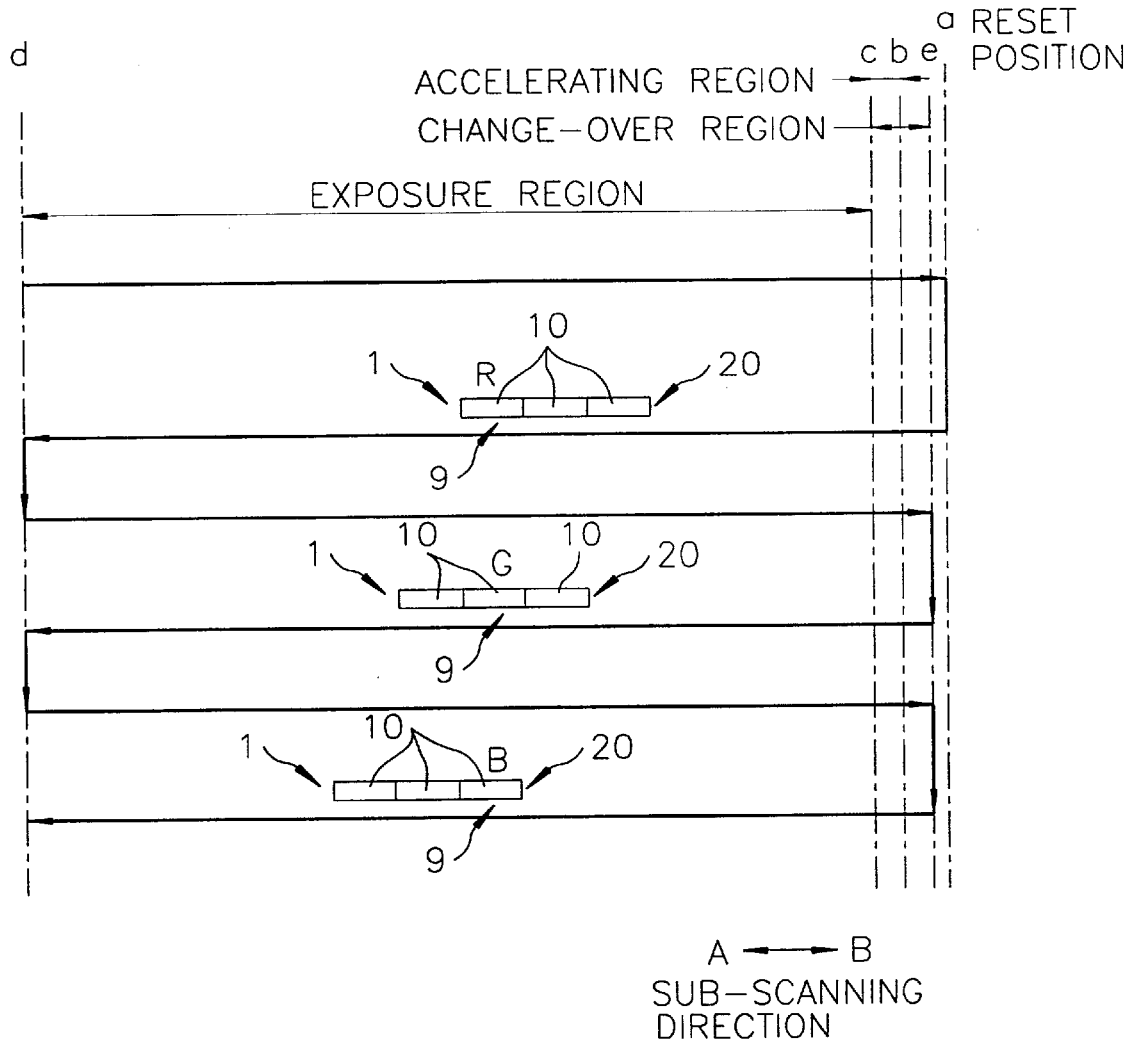
FIG. 9 is a chart showing movement of the print head in the first embodiment of the present invention.

An ordinate row designated as a reference sign "a" in FIG. 9 is referred to a reset position of the filter 10, reference signs "b" to "c" are referred to as an accelerating region of the print head, reference signs "c" to "d" are referred to as a start region and an end region of the exposure, and reference signs "c" to "e" are referred to as a change-over region of the filters 10 of R, G, B. Further, Δ mark in the drawings is referred to as a position of a luminous dot row acting as the luminous source. A full-color latent image is formed by color-separating an image into images in three primary colors of R,G,B and superposing the images on the top of each other.

Firstly, the filter 10 performs an exposure for changing-over into red R. In this case, as shown in FIG. 9, the print head 1 moves to the "a" position. The "a" position is referred to the initial position of the filter holder 20 in which the filter 10 is changed-over to the red R by allowing the transferring abutment 46 and the reset abutment 47 to operate the reset means 26. The print head 1 moves from the "a" position toward one direction(A direction) of the sub-scanning direction, accelerates through the accelerating region of "b" to "c" at a predetermined speed, and then moves to the exposure region of "c" to "d". In synch with the operation, the luminous source 9 is driven by the image signal of red R to thereby form an image in red R on the film 2.

Next, the filter 10 performs the exposure for changing-over into green G. In this case, after such exposure through the above-described red filter R is completed, the print head 1 moves toward the "d" to "e" position in the other direction(B direction) of the sub-scanning direction. In the change-over region of "c" to "e", the transferring abutment 46 permits the print head 1 to move so that the transfer arm 36 is swung by the fixed amount to thereby allow the filter holder 20 to move one pitch of the filter 10. This results in the filter 10, as shown in FIG. 6, changing-over into green G. Thereafter, the print head 1 moves from the "e" position toward one direction(A direction) of the sub-scanning direction(A direction), accelerates through the accelerating region of "b", to "c" at the predetermined speed, and then moves to the exposure region of "c" to "d". In synch with this operation, the luminous source 9 is driven by the image signal of green G to thereby form an image in green G on the film 2.

Thereafter, the filter 10 performs the exposure for changing-over into blue B. In this case, after such exposure through the above-described green filter G is completed, the print head 1 moves toward the "d" to "e" position in the other direction(B direction) of the sub-scanning direction. In the change-over region of "c" to "e", the transferring abutment 46 permits the print head 1 to move so that the transfer arm 36 is swung by the fixed amount to thereby allow the filter holder 20 to move by one pitch of the filter 10. This results in that, at the "e" position, the filter 10, as shown in FIG. 7, is changed-over into blue B. Thereafter, the print head 1 moves from the "e" position toward one direction(A direction) side of the sub-scanning direction, accelerates through the accelerating region of "b" to "c" at the predetermined speed, and then moves to the exposure region of "c" to "d". In synch with this operation, the luminous source 9 is driven by the image signal of blue B to thereby form an image in blue B on the film 2.

Figure 8:
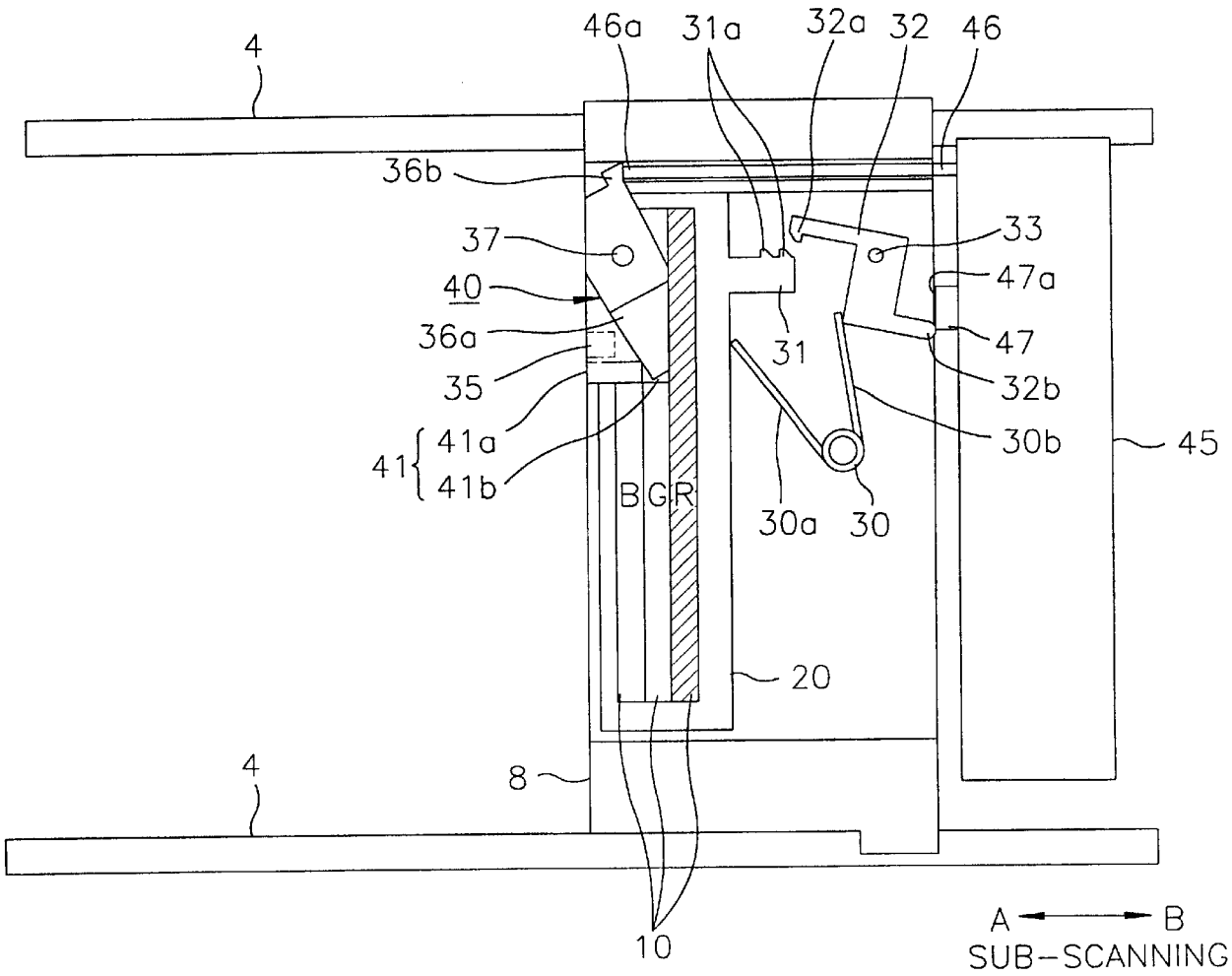

Subsequently, the print head 1 moves to the "a" position in the other direction(B direction) of the sub-scanning direction so that, as shown in FIG. 8, the filter 10 is changed-over again into red R as a result of the transfer abutment 46 and the reset abutment 47 driving the reset means 26.

Therefore, according to the optical printer in the first embodiment, all of the change-overs with respect to each of the filters 10 including the reset operation into red R as well as moving through the accelerating region by the print head 1 are carried out at one end side in the moving region of the print head 1, resulting in the accelerating region being set within the change-over region of the filter 10, reducing the total amount of the print head movement, which will, in turn, allow the down-sizing of the apparatus possible.

More particularly, when the filter 10 is changed-over into G and B by the transfer means 25, the filter holder 20 moves by one pitch by the regular movement between "c" and "e" of the print head 1 as shown in FIG. 9. This makes it unnecessary for the change-over region to be independently disposed at all of the pitches of the conventional filters G, B and allows a common change-over region to be formed, reducing the total amount of the print head movement, which will, in turn, allow to down-sizing of the apparatus possible.

Figure 16:
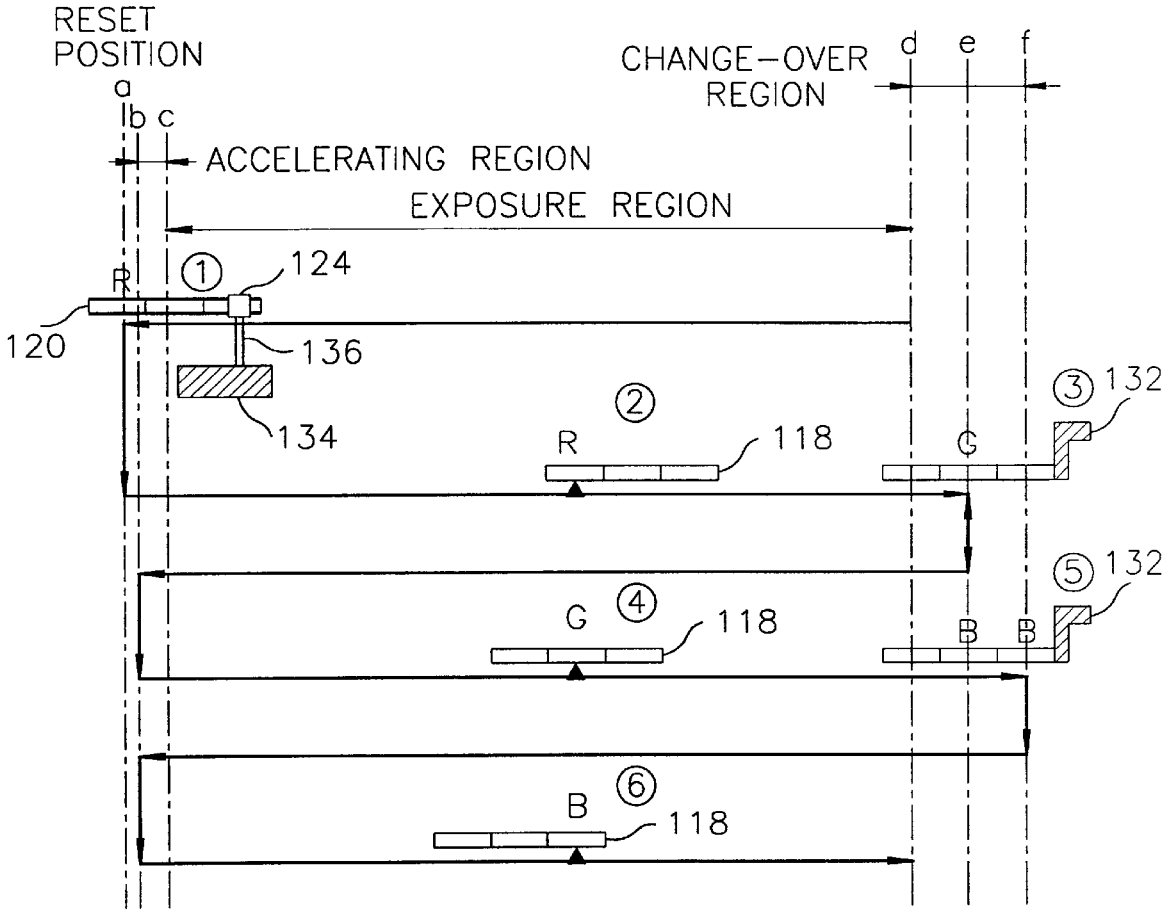
FIG. 16 is a chart showing movement of the conventional print head.

To be more specific, the moving chart of FIG. 9 shows that the exposure region, the accelerating region, the moving by one pitch of the filter, and the amount of moving required to the reset operation by the print head 1 are identical when compared to the conventional moving chart of FIG. 16. However, as is well known from FIG. 9 of the first embodiment of the present invention, the total amount of the print head movement in the first embodiment, when compared to the total amount of the print head movement in FIG. 16, is reduced by movements corresponding the accelerating region and one pitch of the filter.

Further, the amount of movement of the print head 1 is controlled by recognizing a pulse number of the pulse motor 7. Such an amount, as shown in FIG. 9, except for the time of the reset during the movement of the print head 1 in the sub-scanning direction from a right side to a left side or vice versa, is always the same, allowing the pulse motor 7 to be easily controlled.

Hereinafter, the second embodiment of the present invention will be described with reference to the drawings.

The transferring portion 40 of the transfer means 25 in the change-over mechanism of the filter and the operation surface 41 of the reset means 26 incorporated in the transferring portion 40 of the second embodiment are constructed differently from those of the first embodiment described above. Therefore, the parts in the second embodiment having the same construction as those in the first embodiment will not be further discussed herein and they will be affixed with the same reference numerals as the first embodiment. Rather, the following description is only directed to the parts of the second embodiment which are of different elemental construction.

Figure 10A:
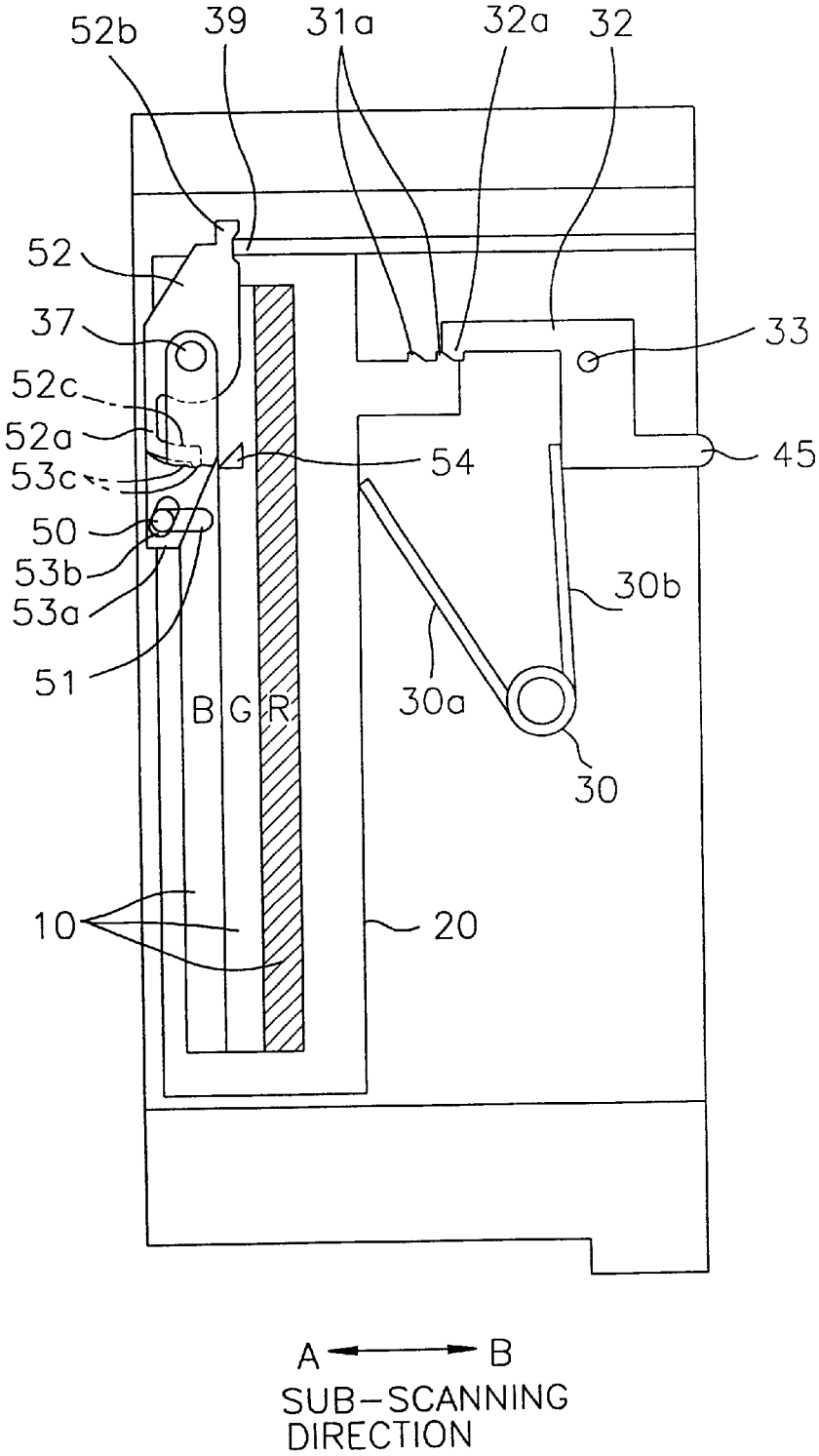
FIGS. 10A and 10B are a plan view showing a change-over mechanism in accordance with a second embodiment of the present invention and an exploded view showing essential parts thereof.
Figure 10B:
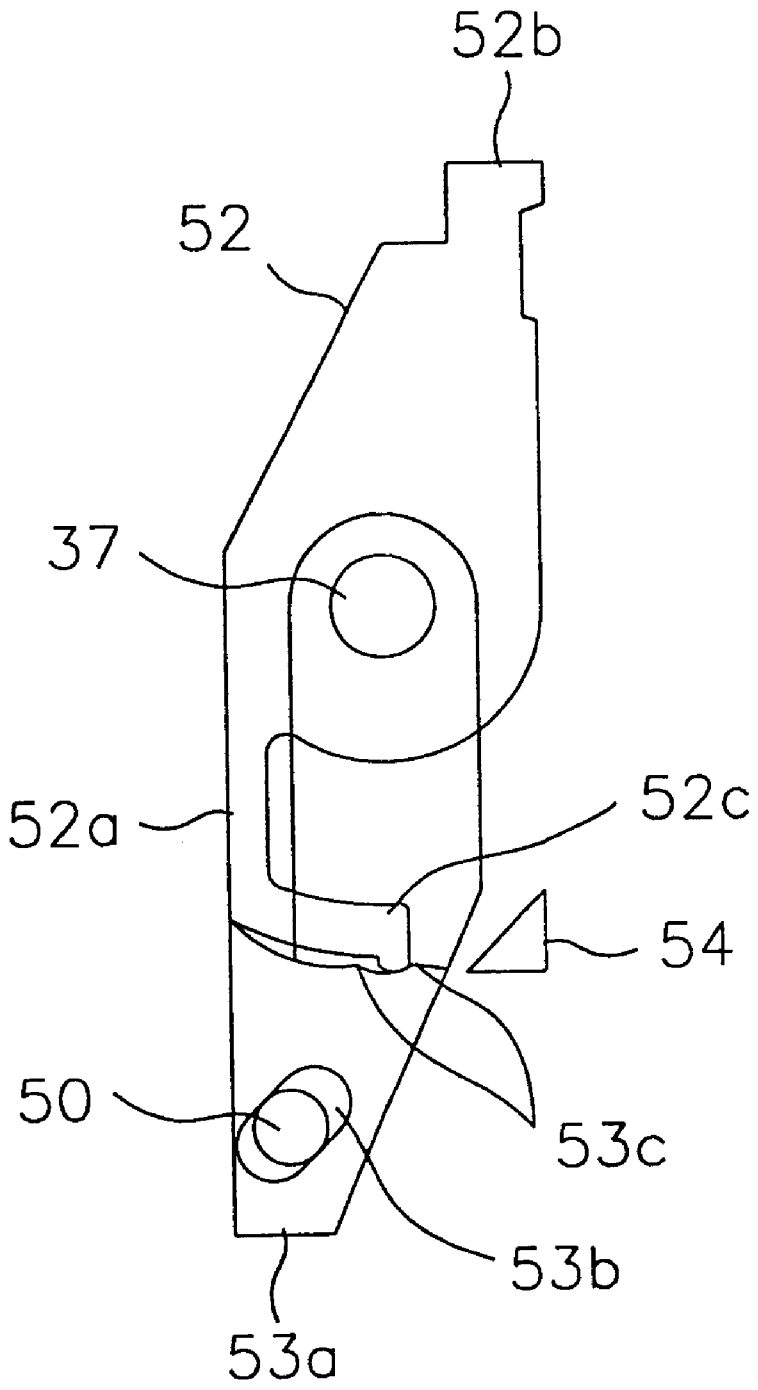
Figure 11C:
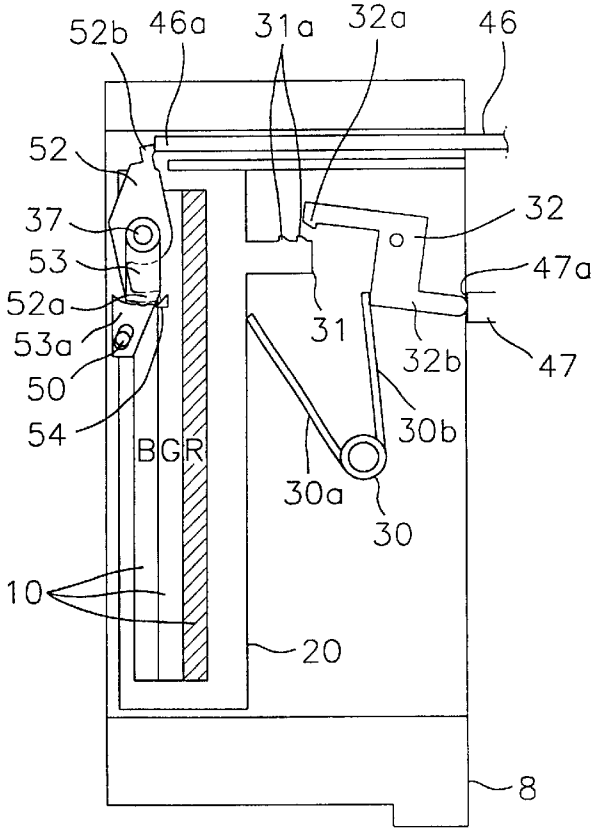
FIGS. 11A to 11C each are plan views showing operation of the change-over mechanism in accordance with the second embodiment of the present invention.
Figure 11B:
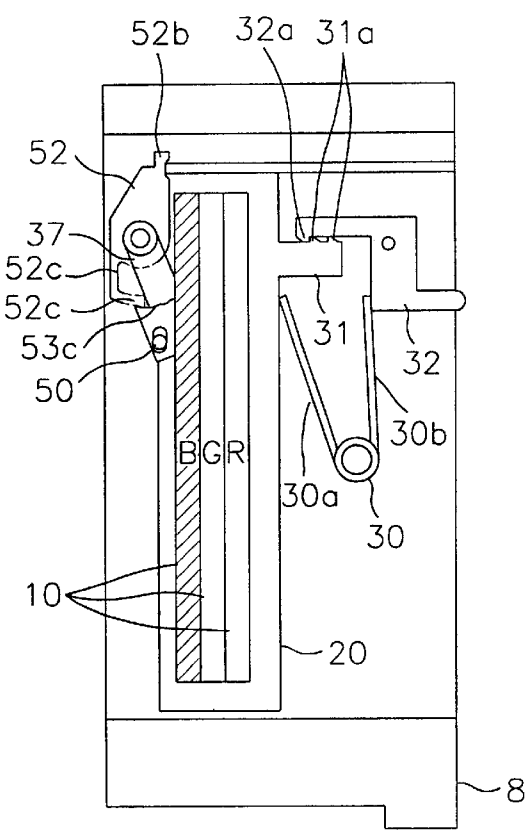
Figure 11A:
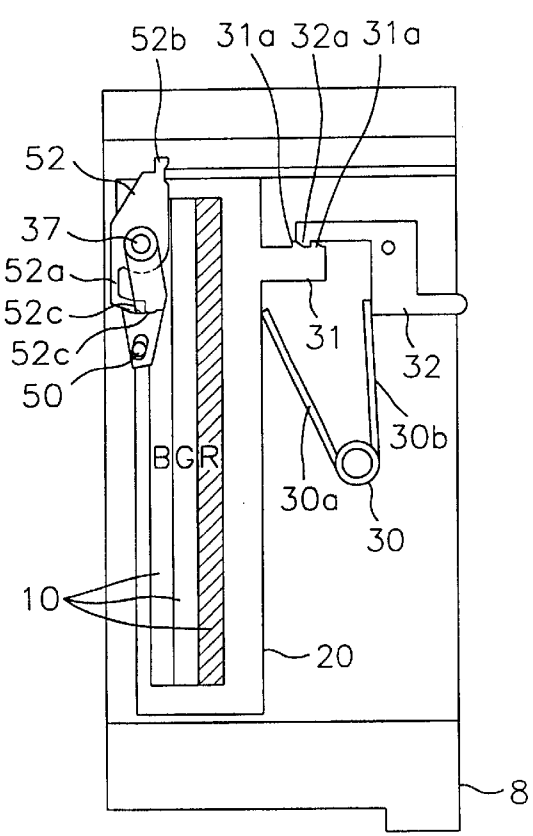

FIG. 10A show a schematic plan view of a change-over mechanism of the second embodiment of the present invention, FIG. 10B illustrates a detailed enlarged view of the change-over mechanism thereof, and FIGS. 11A to 11C are operating diagrams of the change-over mechanism thereof.

First, the transfer means 25 of the transferring portion 40 in accordance with the second embodiment will be described.

An engaging pin 50 projected on the upper layer 8*b* is fixed and points toward an end of one direction(A direction in FIG. 10) of the sub-scanning direction oriented into the resilient supported direction of the filter holder 20. Further, the upper layer 8*b* is provided with a cutout 51 to thereby allow it to be moved together with the engaging pin 50 projected on the upper layer 8*b* by the sliding of the filter holder 20.

Further, a transfer arm 52 is disposed to the upper layer 8*b*. A substantial center portion of the transfer arm 52 is pivoted about the shaft 37 to thereby be swung toward the sub-scanning direction. One end 52*a* of the transfer arm 52 is resiliently supported to thereby be swung in one direction (A direction in FIG. 10) of the sub-scanning direction by a spring(not shown), while the other end 52*b* of the transfer arm 52 is resiliently supported to be swung toward the other direction(B direction in FIG. 10) of the sub-scanning direction by the spring, but the swing of the transfer arm 52 depending on the elastic force of the spring is restricted to a predetermined range by the other end 52*b* coming in contact with the projection 39 which is placed on the base 8.

One end 52*a* of the transfer arm 52 is a flexible and is J-shaped when viewed on a plane. A tip thereof is arc shaped being oriented in the other direction(B direction in FIG. 10) of the sub-scanning direction. A transferring pawl 52*c* projected outward is formed at the tip thereof.

A base end of a follower arm 53 is swingably pivoted to the shaft 37 for pivoting the transfer arm 52. The follower arm 53 is placed on one end 52a of the transfer arm 52. Further, an engaging pin 50 is inserted into a tip 53*a* of the follower arm 53 so as to be supported thereto. The engaging pin 50 moves in the sub-scanning direction by the moving of the filter holder 20 so that the engaging pin 50 is inserted through a lengthwise hole 53*b* into the tip 53*a* of the follower arm 53 without hindering the movement of the engaging pin 50 and its own swing to thereby be supported thereto.

Further, the follower arm 53 is provided with two pawls 53*c* to be engaged with a transferring pawl 52*c* placed to the tip of the transfer arm 52. The pawls 53*c* are formed at the follower arm 53 to be oriented in the same direction and pitch along tip's arc shape of one end 52*a* of the transfer arm 52 with respect to each of the filters 10.

The transferring pawl 52*c* of the transfer arm 52 and each of the pawls 53*c* of the follower arm 53 are engaged with each other when one end 52*a* of the transfer arm 52 is swung toward the other direction(B direction in FIG. 10) of the sub-scanning direction against the elastic force of a spring. That is, when the engaging pin 50 inserted and supported at the tip of the follower arm 53 is pressed toward the other direction of the sub-scanning direction by engaging the transferring pawl 52*c* with the pawl 53*c* as a result of the swing toward the other side of the sub-scanning direction in one end 52*a* of the transfer arm 52, the filter holder 20 moves in the same direction. At this time, the moved filter holder 20 is engaged by the operation of the engaging portion 34 at a position moved by one pitch of the filter 10 (see FIG. 11A).

Further, when one end 52*a* of the transfer arm 52 is swung to be returned by the elastic force of the spring toward one direction(A direction) side of the sub-scanning direction, one end 52*a* having the transferring pawl 52*c* in the transfer arm 52 is twisted to the shaft 37 side so that the transferring pawl 52*c* climbs over each of the pawls 53*c* . That is, the transfer arm 52 returns to a predetermined position where the other end 52*b* comes in contact with the projection 39 as shown in FIG. 10A after the filter holder 20 is moved by one pitch of the filter 10.

Further, as shown in FIGS. 10A and 10B, the transferring pawl 52*c* is engaged with the pawls 53*c* which are adjacent at the other direction(B direction in FIG. 10) side of the sub-scanning direction, while the engaging pawls 32*a* of the engagement 32 and each of the pawls 31*a* of the ratchet 31 in the engaging portion 34 are not engaged with each other to thereby be in the initial position. In this embodiment, the filter 10 of red R corresponds to the through-hole 21.

Further, when the transfer arm 52 is returned to the predetermined position after one end 52*a* of the transfer arm is swung toward the B direction as a result of the transferring pawl 52*c* being engaged with the pawls 53*c* which are adjacent to the other direction (B direction in FIG. 10) side of the sub-scanning direction, the filter holder 20, as shown in FIG. 11A, is moved by one pitch of the filter 10 by the operation of the above-described engaging portion 34 and is engaged therewith, thereby corresponding the filter 10 of green G to the through-hole 21. Further, under this condition, the engaging pin to is further moved by one pitch of the filter 10 as a result of the movement of the filter holder 20 and the follower arm 53 is swung, following up with the movement of the engaging pin 50 so that the transferring pawl 52*c* is separated by one pitch of the filter 10 from the pawl 53*c* which is adjacent to one direction (A direction) side of the sub-scanning direction.

Subsequently, when the transfer arm 52 returns to the predetermined position after one end 52*a* of the transfer arm is swung toward the B direction by the transferring pawl 52*c* being engaged with the pawl 53*c* which is adjacent to one direction(A direction in FIG. 10) side of the sub-scanning direction, the filter holder 20, as shown in FIG. 11B, is further moved by one pitch of the filter 10 by the operation of the above-described engaging portion 34 and engaged therewith, thereby corresponding the filter 10 of blue B to the through-hole 21. Further, under this condition, the engaging pin 50 is further moved by one pitch of the filter 10 as a result of the movement of the filter holder 20 and the follower arm 53 is swung, following up to the movement of the engaging pin 50 so that the transferring pawl 52*c* is placed to be separated by one pitch of the filter 10 from the pawl 53*c* which is adjacent to one direction(A direction) side of the sub-scanning direction.

As described above, the filter holder 20 is moved by one pitch of filter 10 by the regular reciprocating operation of the transfer arm 52. The transferring portion 40 in the transfer means 25 includes the engaging pin 50 for performing this operation, the transfer arm 52, and the follower arm 53.

Hereinafter, the reset means 26 in accordance with the third embodiment of the present invention will be described.

The reset means 26 is disposed in connection with the above-described engagement 32 and the upper layer 8*b* provided with one end 52*a* of the transfer arm 52.

The reset means 26 having the engagement 32 is provided with the operating lever 32*b*, which is identical to that of the first embodiment of the present invention. The engagement 32 is swung against the elastic force of the twist coil spring 30 by the operating lever 32*b* so as to release the engagement of the pawl 31*a* of the ratchet 31 with the engaging pawl 32*a*, resulting in returning of the filter holder 20 to the initial position.

An operating surface 54 coming in contact with the tip of one end 52*a* is disposed on the upper layer 8*b* within the swingable region of a fixed amount. The operating surface 54 faces the tip before the swing of the tip of one end 52*a*. When one end 52*a* of the transfer arm 52 is within the swingable region of the fixed amount so as to allow the filter holder 20 to be swung by one pitch of the filter 10 as described above, the operating surface 54 is placed to be not in contact with the tip of one end 52*a*. Further, when one end 52*a* of the transfer arm 52 is swung from the swingable region toward the other direction(B direction in FIG. 10) side of the sub-scanning direction, the operating surface 54 comes in contact with the tip of one end 52*a*. Further, one end 52*a* of the transfer arm 52 further swung from the swingable region toward the other direction(B direction in FIG. 10) side of the sub-scanning direction becomes twisted so that the operating surface 54 becomes provided with a properly inclined surface to allow the transferring pawl 52*c* placed to the tip to become separated from each of the pawls 53*c* of the follower arm 53.

As shown in FIG. 11C, the filter holder 20 is released to be returned to the initial position by the operation of the operating lever 32*b* of the engagement 32 and that of the operating surface 54. At the same time, the pawls 53*c* are not engaged with the transferring pawl 52*c* in the follower arm 53 which is swung by the above release operation, thereby returning to the initial position without preventing the movement of the filter holder 20.

The abutment 27 includes, as in the first embodiment, the transferring abutment 46 and the reset abutment 47. The transfer arm 52 is swung by a fixed amount by the movement of the transferring abutment 46 to one end side of the print head 1 within the reciprocating region thereof, as shown in FIGS. 11A and 11B, allowing the filter holder 20 to move by one pitch of the filter 10. Further, when the print head 1 is moved more than the moving region in one end side of the reciprocating region of the print head 1, the reset means 26 is operated, as shown in FIG. 11C, forcing the filter holder 20 to be placed at the initial position, as shown in FIGS. 10A and 10B, i.e., the filter 10 is changed-over into red R.

Further, the exposure operation of the optical printer and the change-over of the filter in accordance with the second embodiment are similar to those of the first embodiment which were fully described using the moving chart of FIG. 9.

Therefore, according to the optical printer of the second embodiment, every change-over operations of each of the filters 10 including the reset operation to red R are performed at one end side (A side) of the moving region of the print head 1 and the accelerating region of the print head 1 is commonly set in the above change-over region to thereby reduce the total amount of movement of the print head 1, allowing the apparatus to be down-sized.

Further, similar to the first embodiment, the change-over to green G and blue B of the filters 10 have also a common change-over region where the filter holder 20 moves by one pitch of the filter 10 by the regular movement of the print head 1 depending on the operation of the transfer means 25 to thereby further reduce the total amount of movement of the print head 1, making it possible to down-size the apparatus.

Further, the control of the pulse motor 7 may be also similar to the first embodiment, leading to simplification of the device.

Hereinafter, the third embodiment of the present invention will be described with reference to the drawings.

First, the filter holder 20 is resiliently supported by a tension coil spring 60 in the other direction(B direction in FIG. 12) side of the sub-scanning direction. The filter holder 20 is provided with a ratchet 61 which extends toward the other direction(B direction) side of the sub-scanning direction, i.e., the resiliently supported direction. The ratchet 61 is provided with two pawls 61*a* (upper side) and two pawls 61*b* (lower side), respectively, which are formed in the same direction and pitch as each of the filters 10 at a top end edge and a bottom end edge of the main scanning direction in FIG. 12.

The lower layer 8*a* is provided with an engagement 62. An engaging pawl 62*a* engaged with each of the pawls 61b which is placed to a bottom side of the ratchet 61 is formed on the engagement 62. The engagement 62 is swingably disposed through a shaft 33 with respect to the lower layer 8*a*. The swing of the engagement 62 is resiliently supported by the tension coil spring 60 for resiliently supporting the filter holder 20 to thereby allow the engaging pawl 62*a* to engage with each of the pawls 61*b* of the ratchet 61.

When the filter holder 20 is slid against the elastic force of the tension coil spring 60, the engaging pawl 62*a* of the engagement 62 becomes engaged with each of the pawl 61*b* of the ratchet 61. At this time, it is preferred that the engagement 62 may climb over the pawls 61*b* engaging therewith, thereby swinging against the elastic force of the tension coil spring 60 (see FIG. 13A). Further, when the filter holder 20 is further slid, the engagement 62 climbs over the following pawl 61*b* to thereby be engaged therewith (see FIG. 13B).

Figure 12:
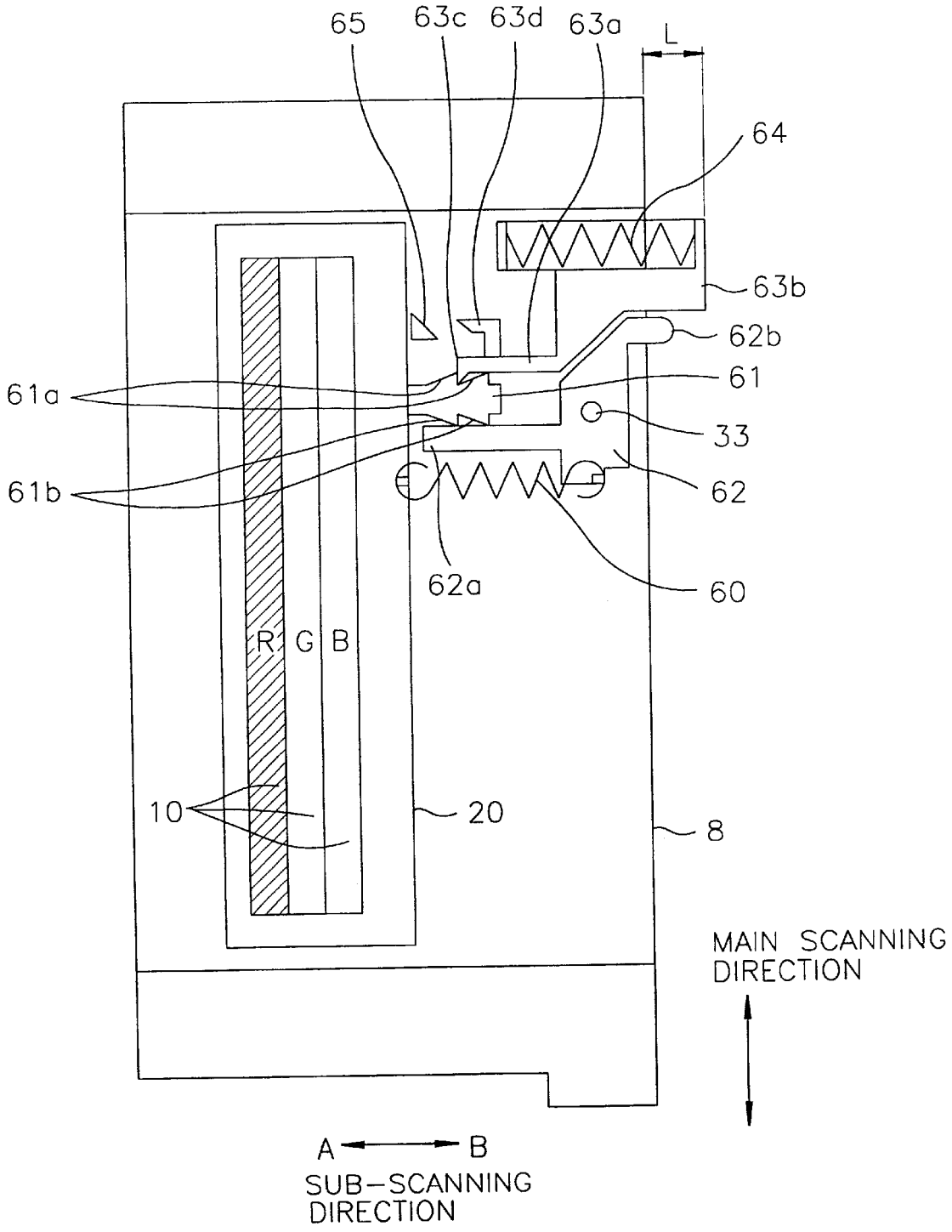
FIG. 12 is a plan view schematic showing a change-over mechanism in accordance with a third embodiment of the present invention.

Further, as shown in FIG. 12, when the engaging pawl 62*a* is not engaged with each of the pawls 61*b*, the engagement 62 and the ratchet 61 are placed at the initial position at which the engagement 62 and the ratchet 61 are nearest to each other. Accordingly, the ratchet 61 (the filter holder 20) moves away from the engagement 62 on the basis of the initial position to allow the engaging pawl 62*a* to be engaged with each of the pawls 61*b*, respectively, to thereby generate three conditions including the above described two conditions (see FIGS. 13A and 13B). These three conditions are provided with a position allowing each of the three filters 10 of R,G,B to correspond to the through-hole 21, respectively. In this embodiment, the filter 10 corresponding to the through-hole 21 in the initial position is red R, the filters 10 of green G and blue B correspond to the through-hole 21 in order of the engaging condition as the ratchet 51 moves away from the engagement 62.

As described above, the engaging portion 34 includes the ratchet 61 placed to the slidable filter holder 20 which is resiliently supported and the engagement 62 allowing the filters 10 of R,G,B of the filter holder 20 slid with respect to the operation of the ratchet 61 to correspond to the through-hole 21, respectively.

Further, a transfer arm 63 is disposed toward the upper layer 8*b*. One end 63*a* of the transfer arm 63 is oriented to the filter holder 20 side, while the other end 63*b* thereof is projected from an end of the other direction (B direction in FIG. 12) side of the sub-scanning direction of the base 8 so that the transfer arm 63 is slidably disposed to the sub-scanning direction. The transfer arm 63 is resiliently supported to be slid toward the other direction (B direction in FIG. 12) side of the sub-scanning direction by a compress coil spring 64. The sliding of the transfer arm 63 is restricted to the other direction (B direction) of the sub-scanning direction at a predetermined position where the other end 63*b* thereof projects from the other direction (B direction) side of the sub-scanning direction by length L in FIG. 12.

One end 63*a* of the transfer arm 63 is a flexible in the main scanning direction and the transferring pawl 63*c* engaged with each of the pawls 61*a* of the ratchet 61 is disposed to a tip thereof. When the transfer arm 63 is slid against the elastic force of the compress coil spring 64 to one direction(A direction in FIG. 2) of the sub-scanning direction, the transferring pawls 63*c* of the transfer arm 63 and each of the pawls 61*a* become engaged with each other.

That is, the filter holder 20 moves in one direction(A direction) of the sub-scanning direction by the engagement of the transferring pawls 63*c* with the pawls 61*a* sliding toward one direction(A direction) side of the sub-scanning direction of the transfer arm 63. At this time, the moved filter holder 20, as shown in FIG. 13A, is engaged at a position where the filter 10 is moved by one pitch by the operation of the above-described engaging portion 34.

Further, when the transfer arm 63 slides toward the other direction(B direction in FIG. 12) side of the sub-scanning direction by the elastic force of the compress coil spring 64, the transferring pawl 63*c* and each of the pawls 61*a* are not engaged at a common slant portion thereof. In this case, one end 63*a* of the transfer arm 63 is twisted upward so that the transferring pawls 63*c* climb over the pawls 61*a*. That is, the transfer arm 63 is returned to a predetermined position where the other end 63*b* is projected by the length L from the other direction(B direction) side of the sub-scanning direction of the base 8 as shown in FIG. 12 after the filter holder 20 is moved by one pitch of the filter 10.

In the engagement of the transferring pawls 63*c* with each of the pawls 61*a*, as shown in FIG. 12, when the transferring pawls 63*c* placed in adjacent to one direction(A direction in FIG. 12) side of the sub-scanning direction are engaged with the pawls 61*a*, it is at an initial position where the engaging pawls 62*a* of the engagement 62 are not engaged with each of the pawls 61*a* of the ratchet 61 and the filter 10 of red R corresponds to the through-hole 21 in this embodiment.

Figure 13C:
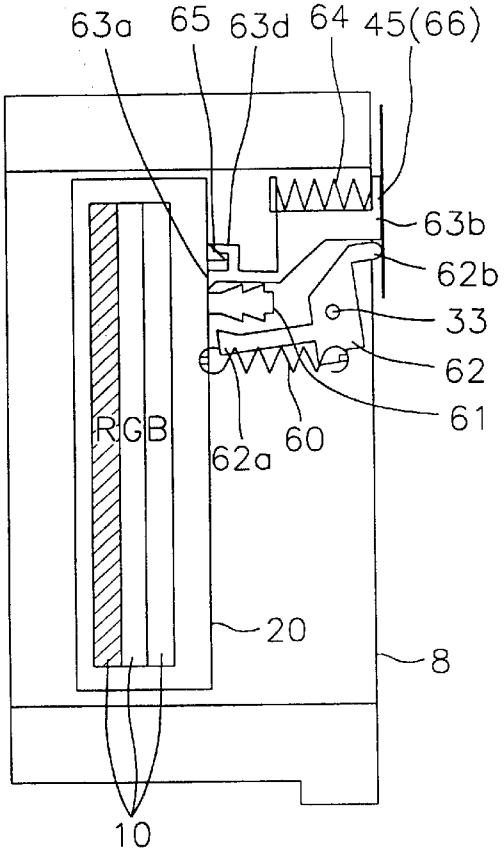
FIGS. 13A to 13C each are plan views showing operation of the change-over mechanism in accordance with the third embodiment of the present invention.
Figure 13B:
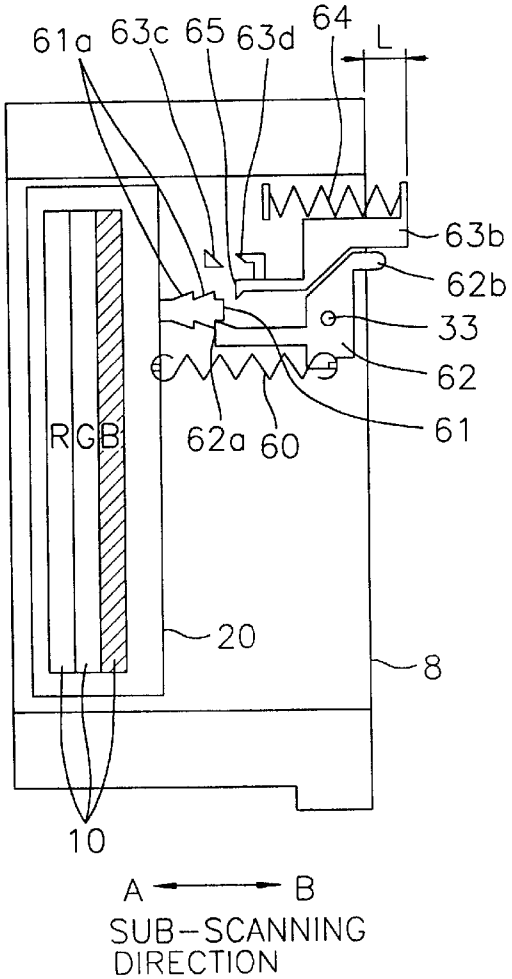
Figure 13A:
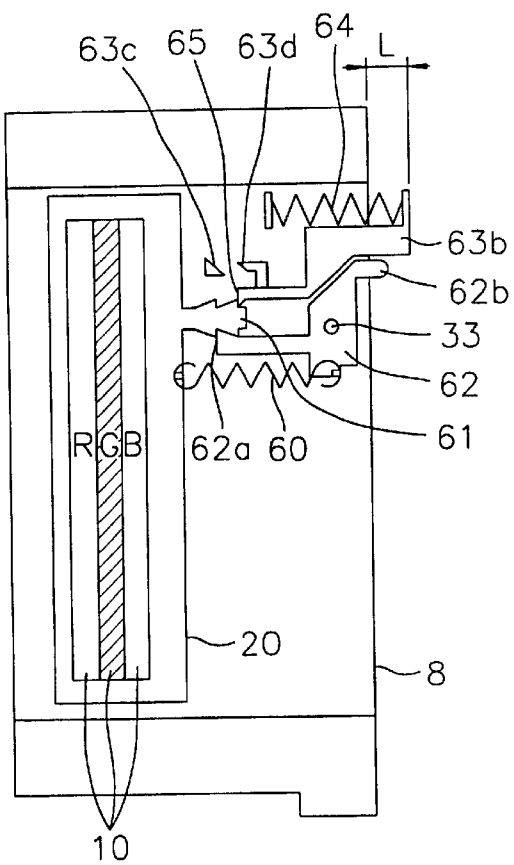
Figure 14:
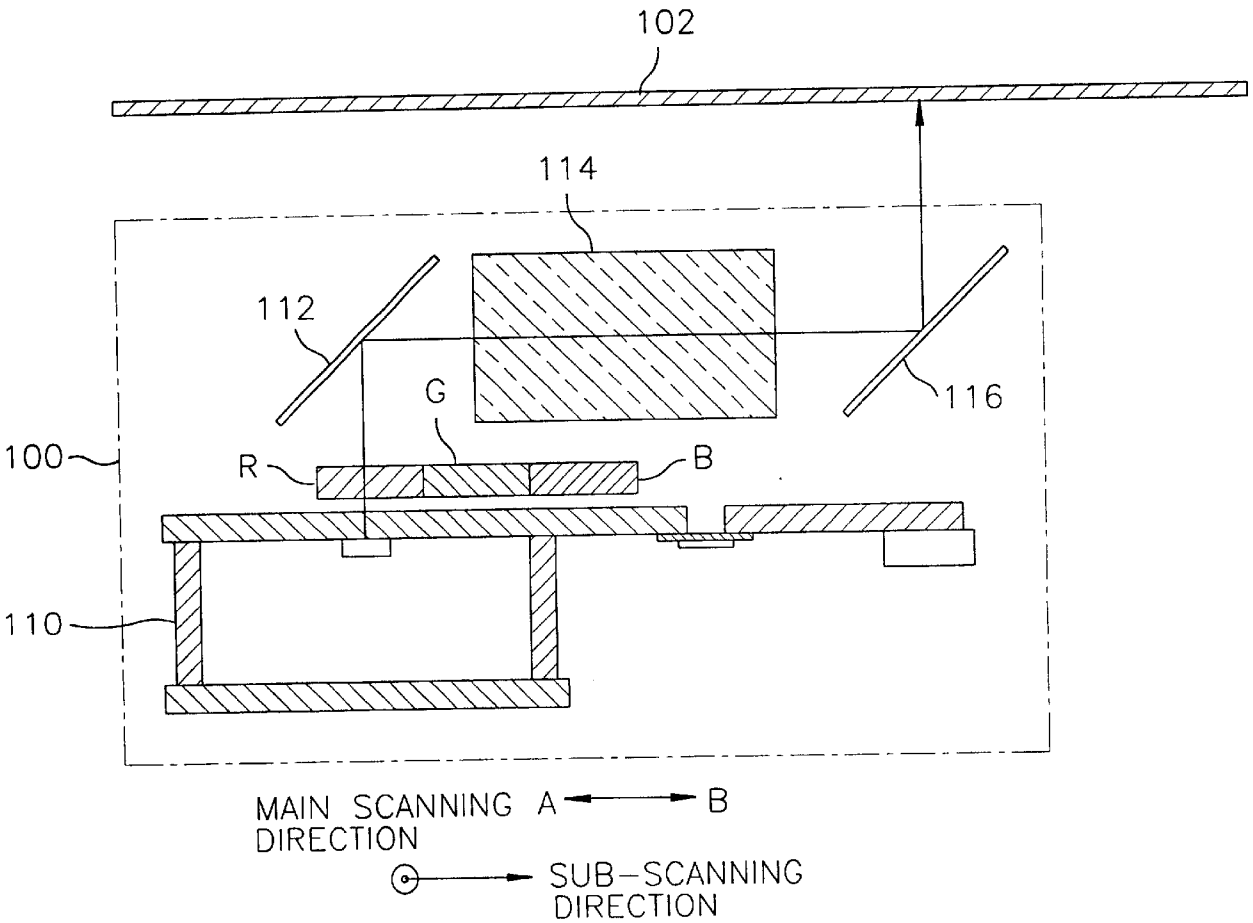
FIG. 14 is a sectional view schematic showing a print head incorporated in a conventional optical printer.
Figure 15:
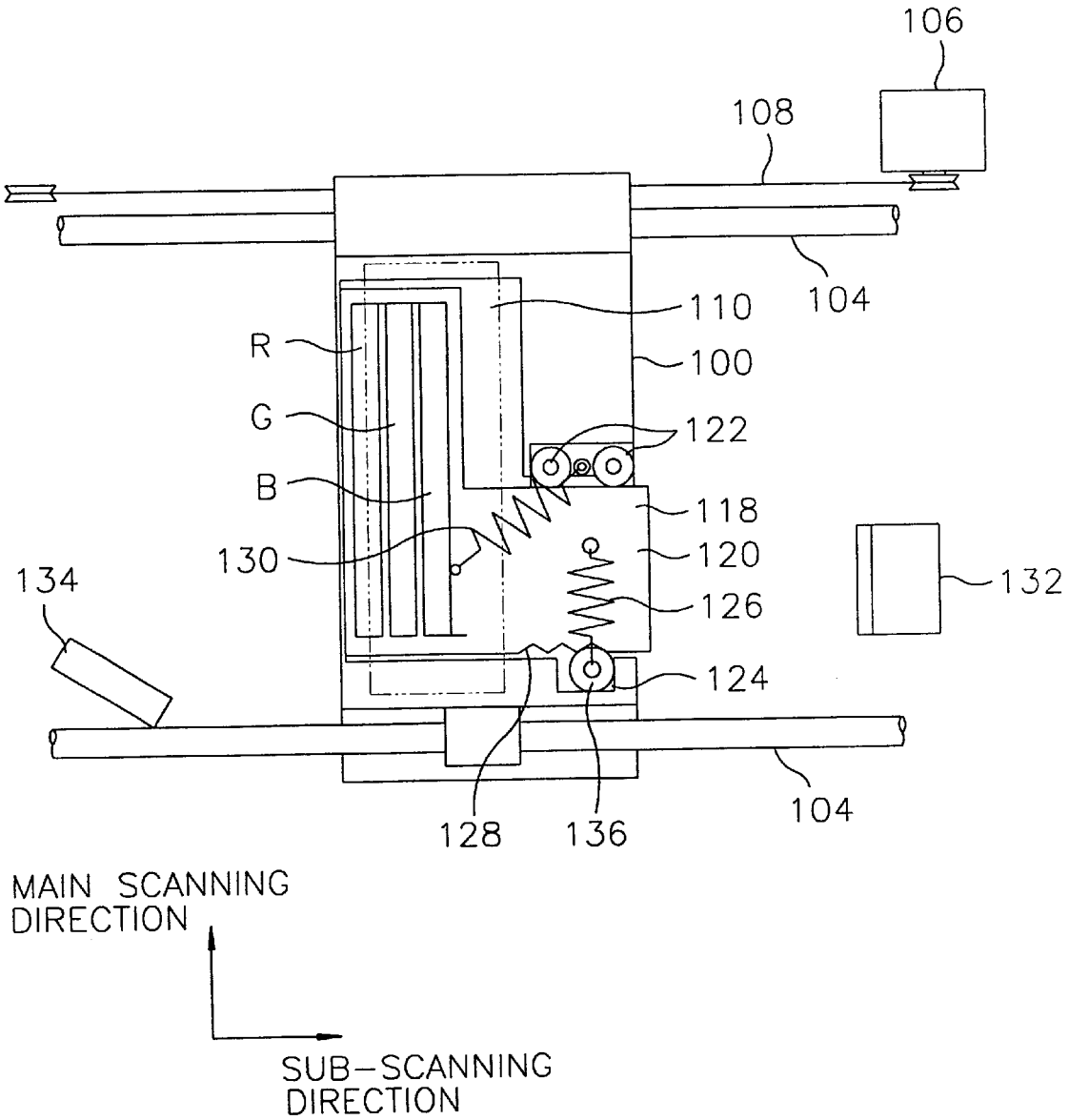
FIG. 15 is a partial plan view showing a conventional print head, with some essential parts omitted therefrom.

Further, after the transfer arm 63 is slid toward the A direction by engaging the transferring pawl 63*c* placed adjacent to the other direction(A direction in FIG. 12) side of the sub-scanning direction with the pawls 61*a*, the transfer arm 63 returns to the above-described predetermined position, the filter holder 20 moves by one pitch of the filter 10 and becomes engaged by the operation of the engaging portion 34 as shown in FIG. 13A to thereby allow the filter 10 of green G to correspond to the through-hole 21. Further, under this condition, since the filter holder 20 is moved by one pitch of the filter 10, the transferring pawls 63*c* placed adjacent to the other direction(B direction) side of the sub-scanning direction become engaged with the pawls 61*a*.

Next, the transferring pawls 63*c* placed adjacent to the other direction(B direction in FIG. 12) side of the sub-scanning direction are engaged with the pawls 61*a* so that, the transfer arm 63 returns to the above-described predetermined position after the transfer arm 63 is slid toward the A direction, and the filter holder 20, as shown in FIG. 13B, moves by one pitch of the filer 10 and become engaged by the operation of the above-described engaging portion 34, allowing the filter 10 of blue B to correspond to the through hole 21. Further, under this condition, since the filter holder 20 is further moved by one pitch of the filter 10, the transferring pawls 63*c* placed adjacent to the other direction(B direction) side of the sub-scanning direction are placed away by one pitch of the filter 10 from the pawls 61*a*.

As described above, the transfer arm 63 permits the filter holder 20 to move by one pitch of the filter 10 by the regular amount of the reciprocating operation. In order to perform the operation, the transferring portion 40 in the transfer means 25 includes the pawls 61*a* of the ratchet 61 and the transfer arm 63.

The reset means 26 in accordance with the third embodiment will be described hereinafter.

The reset means 26 is disposed by the above-described engagement 62 and the upper layer 8*b* connected with one end 63*a* of the transfer arm 63.

The reset means 26 having the engagement 62 is so constructed to be provided with an operating lever 62*b* which is swung against the elastic force of the tension coil spring 60, releasing the engaging condition of each of the pawls 61*b* of the ratchet 61 with the engaging pawl 62*a*, thereby returning the filter holder 20 to the initial position.

A releasing lever 63*d* is disposed to one end 63*a* of the transfer arm 63. The releasing lever 63*d* extends from a center portion of one end 63*a* having a flexible property to form about L-shaped configuration so that the tip thereof is oriented toward one direction(A direction in FIG. 12) of the sub-scanning direction.

Further, an operating surface 65 coming in contact with the tip of the releasing lever 63*d* placed to one end 63*a* is disposed on the upper layer 8*b* within the slidable region of one end 63*a* of the transfer arm 63. The operating surface 65 faces the tip prior to the tip of the releasing lever 63*d* is slid. When the transfer arm 63 is placed in the slidable region where the filter holder 20 is allowed to move a regular amount, i.e., one pitch of the filter 10 as described above, the operating surface 65 is placed at a position where it is not in contact with the tip of the releasing lever 63*d*. When the transfer arm 63 is slid from the regular sliding region toward the other direction(B direction in FIG. 12) of the subscanning direction, the operating surface 65 comes in contact with the tip of the releasing lever 63*d*. Further, one end 63*a* of the transfer arm 63 further slid from the regular slidable region toward the other direction(B direction) of the sub-scanning direction is twisted by the operating surface 65 so that the transferring pawls 63*c* placed to the tip thereof become distanced from each of the pawls 61*a* of the ratchet 61, thereby forming a properly inclined surface.

Since the operating lever 62*b* of the engagement 62 and the operating surface 65 are operated together, the filter holder 20 is released to be returned to the initial position as shown in FIG. 13C. At the same time, the transferring pawls 63*c* are not engaged with each of the pawls 61*a*, thereby allowing the filter holder to return to the initial position without the filter holder 20 moving.

Next, the abutment 27 in accordance with the third embodiment of the present invention will be described.

The abutment 27 is disposed to the abutting base 45 (similar to the first embodiment, see FIG. 3) fixed to one end side of the reciprocating region of the print head 1 in the other direction(B direction in FIG. 12) side of the sub-scanning direction with respect to a chassis (not shown) of the optical printer having the moving mechanism 3 for moving the print head 1.

In the abutting base 45, a transferring abutment 66 is so constructed to allow a surface of one direction(A direction in FIG. 3) side of the sub-scanning direction to face the print head 1, forming the transferring abutment and the reset abutment of the first and the second embodiments.

The transferring abutment 66 is abutted to the other end 63*b* of the transfer arm 63 consisting of the transferring portion 40 of the transfer means 25. When the print head 1 moves toward the other direction (B direction in FIG. 12) side of the sub-scanning direction and reaches to one end side of the reciprocating region of the print head 1, the transferring abutment 66 becomes abutted to the other end 63*b* of the transfer arm 63. The transferring abutment 66 allows the transfer arm 63 to slide by a fixed amount during the movement of the print head 1. This results in the filter holder 20 moving by one pitch of the filter 10. Further, when the print head 1 moves more toward the other direction (B direction) side of the sub-scanning direction than that of the transfer arm 63 is slid, the transferring abutment 66 operates to allow one end 63*a* of the transfer arm 63 to be raised upward by the releasing lever 63*d* and the operating surface 65.

Further, when the print head 1 moves toward the other direction (B direction in FIG. 12) side of the sub-scanning direction, reaching one end side of the reciprocating region, the transferring abutment 66 becomes abutted to the operating lever 62*b* of the engagement 62. To be more specific, the transferring abutment 66 becomes abutted, not during the regular sliding of the transfer arm 63, but when the print head 1 moves more toward the other direction(B direction) side of the sub-scanning direction than the regular sliding region of the transfer arm 63, raising upward one end 63*a* of the transfer arm 63 by the releasing lever 63*d* and the operating surface 65.

As a result, the transferring abutment 66 operates to allow the transfer arm 63 to be regularly swung by the movement of the print head 1 to one end side of the reciprocating region as shown in FIGS. 13A and 13B, moving the filter holder 20 by one pitch of the filter 10. Further, when the print head 1 moves further toward one end side of the reciprocating region thereof, the transferring abutment 66, as shown in FIG. 13*c*, functions to operate the reset means 26, moving the filter holder 20 to the initial position where the filter 10 is changed-over to red R.

Further, the exposure operation and the change-over operation of the optical printer in the third embodiment is performed in the same manner as the operation as shown in the moving chart of FIG. 9 in accordance with the first embodiment.

According to the optical printer in the third embodiment, in the same manner as the first embodiment, all of the changing-over of each of the filters 10 including the reset operation to red R are performed at one end side (A side) of the moving region of the print head 1. At the same time, the accelerating region of the print head 1 is set commonly within the change-over region so that the total amount of movement of the print head 1 is reduced, leading to down-sizing of the apparatus.

Further, since the change-over of the filter 10 to G,B is also similar to the first embodiment, the filter holder 20 is moved by one pitch of the filter 10 by the regular movement of the print head 1 at the common change-over region, allowing the total amount of movement of the print head 1 to be further reduced, making it possible further down-size the apparatus.

Further, the control of the pulse motor 7 can be also simplified as in the first embodiment.

Particularly, the optical printer in the third embodiment is so constructed that the transfer means 25 and the reset means 26 are concentrated at one side of the filter holder 20, e.g., the other direction side of the sub-scanning direction, allowing an easy assembling the parts and the like.

Further, the transfer means 25 and the reset means 26 of the third embodiment in the optical printer operate only in the sub-scanning direction and do not allow vertical movements thereof, making it possible to further thin, and hence down-size, the print head 1.

Incidentally, although the accelerating regions in the first to third embodiments are disposed within the change-over region, allowing all of the change-overs of each of the filter 10 including the reset region, i.e., toward one end side (A side) of the moving region of the print head 1, to be performed therein, the accelerating region can also be set at the other end side (B side) of the moving region of the print head 1. In both cases, the total amount of movement is reduced by one pitch of the filter 10 in comparison with the prior art, allowing further down-sizing of the apparatus possible.

Further, although the accelerating region is set at the other end side (B side) of the moving region of the print head 1, the amount of moving required for reciprocating the print head 1 between one end side and the other end side thereof is all the same except for the reset operation, thereby simplifying the control of the pulse motor 7.

The optical printer in accordance with the present invention includes a transfer means for moving a plurality of filters moving toward a predetermined direction by a regular amount in such a way that it sets a desired filter to a luminous source, the transfer means being located at and operates from one end side of the moving region of the print head and moving toward a particular direction by the regular amount, and the reset means for returning the filter to the original position in one end side of the moving region.

That is, in the change-over of the filters, a desired filter is set to the luminous source by the regular moving of the transfer means by a fixed amount(by one pitch). Such an operation is accomplished by the transfer means moving toward one end side of the print head. As a result, since, in changing-over the plurality of filters, the change-over region of the moving print head corresponds to a regular amount of movement of the transfer means, i.e., by one pitch of filter, and this is common to all of the filters, the total amount of movement of the print head 1 is reduced, leading to a down-sizing of the apparatus.

Further, the filter is changed-over at each pitch by the regular amount of movement of the transfer means, and this is accomplished by the print head moving. As a result, the change-over region of the print head moved in order to change-over the plurality of filters corresponds to one pitch of the filter, and this common to all of the filters, so that the change-over thereof is all the same except for when movement each of the filters is reset, leading to simplifying of the moving control of the print head.

Furthermore, although the accelerating regions in the present invention are disposed within the change-over region, allowing all of the change-overs of each of the filter 10 including the reset region, i.e., toward one end side (A side) of the moving region of the print head 1, to be performed therein, the accelerating region can also be set at the other end side (B side) of the moving region of the print head 1. In both cases, the total amount of movement is reduced by one pitch of the filter 10 in comparison with the prior art, allowing further down-sizing of the apparatus possible.

While the present invention has been described with respect to the particular embodiments, it will be apparent to those skilled in the art that various changes and modifications may be made without departing from the spirit and scope of the invention as defined in the following claims.

What is claimed is:

1. An optical printer for optical writing on a recording medium, the optical printer comprising:

a print head including a luminous source and a plurality of filters for being selectively aligned with the luminous source by moving parallel to a predetermined direction;

a head moving unit for allowing the print head to be reciprocated parallel to the predetermined direction, the print head moving in a print head moving region;

a transfer unit disposed in the print head and for moving the filters along the predetermined direction by a preset distance, thereby placing a desired filter in front of the luminous source;

an abutting unit disposed close to one end side of the print head moving region, the abutting unit being coupled with the transfer unit when the print head is moved to one end side of the print head moving region, thereby allowing the transfer unit to move the filters along the predetermined direction by the preset distance; and a reset unit disposed in the print head for resetting the filters to their initial positions when the print head is moved beyond said one end side of the print head moving region, wherein the print head moving region includes a print head accelerating region located close to said one end side for accelerating the print head toward the other end side of the print head moving region until the print head gains a predetermined speed.

2. The optical printer according to claim 1, wherein the filters are disposed to have a predetermined pitch therebetween along the predetermined direction and is maintained on a filter holder being urged to move along the opposite direction of the predetermined direction by a resilient force, the transfer unit includes a transferring portion detachably engaged to the filter holder and for moving the filter holder by the predetermined pitch against the resilient force when coupled with the abutting unit, and an engagement engaged with the filter holder moved by the transferring portion, thereby positioning the desired filter in front of the luminous source, and the reset unit releases the filter holder from the engagement and the transferring portion when the print head is moved beyond the print head moving region.

3. The optical printer according to claim 1, wherein the print head accelerating region is set within the change-over region of the filter.

4. A print head for use in an optical printer for optical writing on a recording medium while the print head moves along a predetermined direction by a head moving unit, the print head comprising:

a base having a luminous source and being moved parallel to the predetermined direction by the head moving unit;

a filter holder having a plurality of filters with a predetermined pitch therebetween along the predetermined direction, the filter holder being urged by a resilient force to move along the predetermined direction;

a transfer unit coupled with a portion of the optical printer to move the filter holder against the resilient force by the predetermined pitch along the opposite direction of the predetermined direction when the base is moved to one end side of a print head moving region by the moving unit and hold the filter holder thereat, thereby positioning a desired filter in front of the luminous source; and a reset unit for releasing the filter holder from the transfer unit when the base is moved beyond said one end side of the print head moving region, thereby restoring the filter holder at its initial position, wherein the transfer unit includes a transferring portion detachably engaged to the filter holder and for moving the filter holder by the predetermined pitch against the resilient force when coupled with the portion of the optical printer, and an engagement engaged with the filter holder moved by the transferring portion, thereby positioning the desired filter in front of the luminous source, and the reset unit releases the filter holder from the engagement and the transferring portion when the base is moved beyond said one end side of the print head moving region.

5. An optical printer comprising:

an optical head having a light source and a set of color filters including a first filter and more than one different second filters;

a head moving unit for moving the optical head in a head moving region, the head moving region including an exposure region where the optical head moves at a speed, a filter change-over region and a head acceleration region where the optical head is accelerated to gain the speed, and one of the change-over region and the head acceleration region substantially overlaps with the other spatially; and a filter change-over unit for aligning one of the second filters in front of the light source at the filter change-over region.

6. The optical printer according to claim 5, wherein the head moving region further includes a reset region located at the opposite side of the exposure region with respect to the filter change-over region, and the optical printer further comprising a reset unit for aligning the first filter in front of the light source at the reset region.

7. The optical printer according to claim 6, wherein the head accelerating region a part of the filter change-over region.

8. The optical printer according to claim 5, wherein the head accelerating region is a part of the filter change-over region.

* * * * *